US005720336A

United States Patent [19]

Strezov

[11] Patent Number: 5,720,336

[45] Date of Patent: Feb. 24, 1998

[54] CASTING OF METAL

[75] Inventor: Lazar Strezov, Adamstown, Australia

[73] Assignees: Ishikawajima-Harima Heavy Industries Company Ltd., Tokyo, Japan; BHP Steel (JLA) Pty. Ltd., Melbourne, Australia

[21] Appl. No.: 609,750

[22] Filed: Mar. 1, 1996

[30] Foreign Application Priority Data

Mar. 15, 1995 [AU] Australia ..... PN1764

[51] Int. Cl.[6] ..... B22D 11/06; B22D 11/07

[52] U.S. Cl. ..... 164/480; 164/428; 164/472

[58] Field of Search ..... 164/122, 480, 164/479, 429, 428, 472

[56] References Cited

U.S. PATENT DOCUMENTS 5,520,243 5/1996 Freeman et al. ..... 164/479

FOREIGN PATENT DOCUMENTS 63-30160 2/1988 Japan ..... 164/472

6-304713 11/1994 Japan ..... 164/480

626279 11/1981 Switzerland ..... 164/479

*Primary Examiner*—Kuang Y. Lin

*Attorney, Agent, or Firm*—Nikaido Marmelstein Murray & Oram, LLP

[57] ABSTRACT

Method for continuously casting metal strip of the kind in which molten metal is introduced into the nip between a pair of parallel casting rolls (16) via a metal delivery nozzle (19) disposed above the nip to create a casting pool (30) of molten metal supported on casting surfaces (16A) of the rolls immediately above the nip and the casting rolls (16) are rotated to deliver a solidified metal strip (20) downwardly from the nip. The casting surfaces (16A) are smooth so as to have an Arithmetic Mean Roughness Value ($R_a$) of less than 5 microns and the casting pool contains material to form on each of the casting surfaces a thin layer interposed between the casting surface and the casting pool during metal solidification a major proportion of which layer is liquid during the metal solidification and the liquid of the layer has a wetting angle of less than 40° on the casting surface. This promotes wetting of the smooth casting surfaces and increases heat flux during metal solidification.

11 Claims, 27 Drawing Sheets

CASTING OF METAL

BACKGROUND OF THE INVENTION

This invention relates to the casting of metal. It has particular but not exclusive application to the casting of ferrous metal strip.

It is known to cast metal strip by continuous casting in a twin roll caster. In this technique molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem has been the achievement of sufficiently rapid and even cooling of metal over the casting surfaces of the rolls.

Our International Patent Application PCT/AU93/00593 describes a development by which the cooling of metal at the casting surface of the rolls can be dramatically improved by taking steps to ensure that the roll surfaces have certain smoothness characteristics in conjunction with the application of relative vibratory movement between the molten metal of the casting pool and the casting surfaces of the rolls. Specifically that application discloses that the application of vibratory movements of selected frequency and ,amplitude make it possible to achieve a totally new effect in the metal solidification process which dramatically improves the heat transfer from the solidifying molten metal, the improvement being such that the thickness of the metal being cast at a particular casting speed can be very significantly increased or alternatively the speed of casting can be substantially increased for a particular strip thickness, The improved heat transfer is associated with a very significant refinement of the surface structure of the cast metal.

Our Australian Patent Application 17896/95 describes a further development whereby effective relative vibration between the molten metal of the casting pool and the casting surface can be induced by the application of sound waves to the molten metal of the casting pool whereby increased heat transfer and solidification structure refinement can be achieved by the application of sound waves in the sonic range at quite low power levels.

SUMMARY OF THE INVENTION

We have now carried out extensive research on the heat transfer mechanism occurring at the interface between the casting surface and the molten metal of the casting pool and have determined that the heat flux on solidification can be controlled and enhanced by ensuring that the casting surfaces are each covered by a layer of a material which is at least partially liquid at the solidification temperature of the metal, It is thus possible in accordance with the invention to achieve improved heat transfer and this may be achieved without necessarily generating relative vibration between the casting pool and the rolls. If the enhanced heat transfer is produced in accordance with the invention on a smooth casting surface it is possible also to achieve refined surface structure of the cast metal.

In the ensuing description it will be necessary to refer to a quantitative measure of the smoothness of casting surfaces. One specific measure used in our experimental work and helpful in defining the scope of the present invention is the standard measure known as the Arithmetic Mean Roughness Value which is generally indicated by the symbol $R_a$. This value is defined as the arithmetical average value of all absolute distances of the roughness profile from the centre line of the profile within the measuring length $l_m$. The centre line of the profile is the line about which roughness is measured and is a line parallel to the general direction of the profile within the limits of the roughness-width cut-off such that sums of the areas contained between it and those parts of the profile which lie on either side of it are equal. The Arithmetic Mean Roughness Value may be defined as $$R_a = \frac{1}{l_m} \int_{x=0}^{x=l_m} |y| dx$$

According to the invention there is provided a method of casting metal in which molten metal solidifies in contact with a casting surface, wherein the casting surface has an Arithmetic Mean Roughness Value ($R_a$) of less than 5 microns and there is interposed between the casting surface and the molten metal during solidification a layer of material a major proportion of which layer is liquid during the metal solidification and the liquid of the layer has a wetting angle of less than 40° on said casting surface.

Preferably said layer is less than 5 microns thick.

The invention further provides a method for continuously casting metal strip of the kind in which the casting pool of molten metal is formed in contact with a moving casting surface such that metal solidifies from the pool onto the moving casting surface, wherein the casting surface has an Arithmetic Mean Roughness Value ($R_a$) of less than 5 microns and there is interposed between the casting surface and the casting pool during said metal solidification a layer of material a major proportion of which layer is liquid during the metal solidification.

Said layer of material may be generated entirely from the casing pool. Alternatively it may comprise material applied to the casting surface at a position in advance of its contact with the casting pool.

The metal may be steel in which case the casting pool may contain oxides of iron, manganese and silicon and said layer may comprise a mixture of iron, manganese and silicon oxides, the proportions of the mixture being such that the mixture is at least partially liquid during metal solidification.

The pool may further comprise aluminium oxide and said layer may comprise a mixture of iron, manganese, silicon and aluminium oxides.

The method of the invention may be carried out in a twin roll caster.

Accordingly the invention further provides a method of continuously casting metal strip of the kind in which molten metal is introduced into the nip between a pair of parallel casting rolls via a metal delivery nozzle disposed above the nip to create a casting pool of molten metal supported on casting surfaces of the rolls immediately above the nip and the casting rolls are rotated to deliver a solidified metal strip downwardly from the nip, wherein there is interposed between each of the casting surfaces of the rolls and the casting pool during said metal solidification a layer of material a major proportion of which layer is liquid during the metal solidification.

It is preferred that the liquid fraction in the layer be at least 0.75.

Preferably the casting pool contains the material which forms the layer on each of the casting surfaces of the rolls as they come into contact with the pool on rotation of the rolls.

The casting rolls may be chrome plated such that the casting surfaces are chrome plating surfaces.

The metal may be steel, in which case the pool may contain slag comprising iron, manganese and silicon oxides and said layer may comprise iron, manganese and silicon oxides deposited on the casting roll from the slag.

The slag may also comprise aluminium oxide and said material may accordingly comprise a mixture of iron, manganese, silicon and aluminium oxides.

BRIEF DESCRIPTION OF THE DRAWINGS

In order that the invention may be more fully explained the results of experimental work carried out to date will be described with reference to the accompanying drawings in which.

DETAILED DESCRIPTION OF PREFERRED EMBODIMENTS

Figure 1:
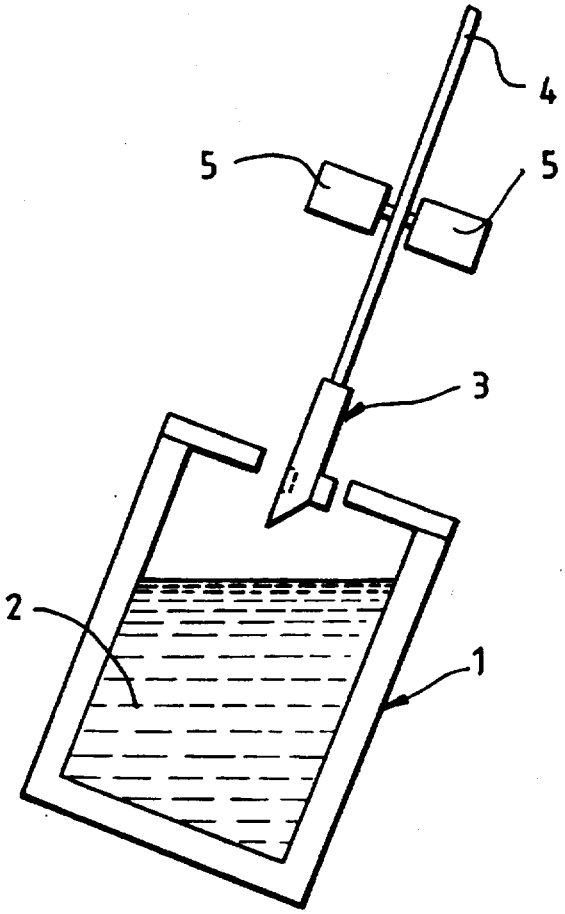
FIG. 1 illustrates experimental apparatus for determining metal solidification rates under conditions simulating those of a twin roll caster.
Figure 2:
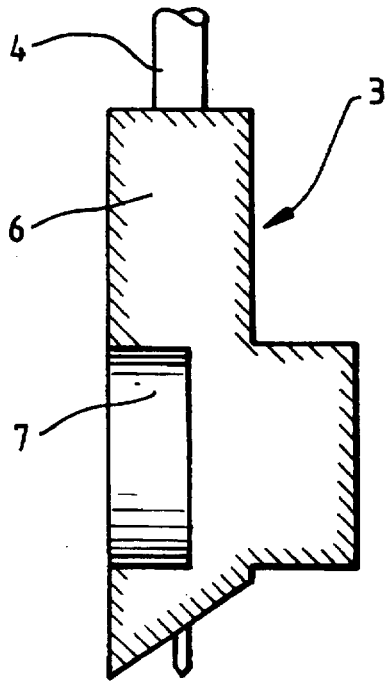
FIG. 2 illustrates an immersion paddle incorporated in the experimental apparatus of FIG. 1.

FIGS. 1 and 2 illustrate a metal solidification test rig in which a 40 mm×40 mm chilled block is advanced into a bath of molten steel at such a speed as to closely simulate the conditions at the casting surfaces of a twin roll caster. Steel solidifies onto the chilled block as it moves through the molten bath to produce a layer of solidified steel on the surface of the block. The thickness of this layer can be measured at points throughout its area to map variations in the solidification rate and therefore the effective rate of heat transfer at the various locations. It is thus possible to produce an overall solidification rate as well as total heat flux measurements. It is also possible to examine the microstructure of the strip surface to correlate changes in the solidification microstructure with the changes in observed solidification rates and heat transfer values.

The experimental rig illustrated in FIGS. 1 and 2 comprises an induction furnace 1 containing a melt of molten metal 2 in an inert atmosphere of argon gas. An immersion paddle denoted generally as 3 is mounted on a slider 4 which can be advanced into the melt 2 at a chosen speed and subsequently retracted by the operation of computer controlled motors 5.

Immersion paddle 3 comprises a steel body 6 which contains a substrate 7 in the form of a chrome plated copper disc of 46 mm diameter and 18 mm thickness. It is instrumented with thermo-couples to monitor the temperature rise in the substrate which provides a measure of the heat flux.

Tests carried out on the experimental rig illustrated in FIGS. 1 and 2 have demonstrated that the observed solidification rates and heat flux values as well as the microstructure of the solidified shell are greatly affected by the conditions at the shell/substrate interface during solidification and that significantly increased heat flux and solidification rates can be achieved by ensuring that the substrate is covered by a partially liquid layer during the solidification process so that the layer is interposed between the substrate and the solidifying shell. The tests have shown that high heat flux and solidification rates can be achieved with smooth substrate surfaces having an Arithmetical Mean Roughness Value ($R_a$) of less than 5 microns and that this results in a refinement of the grain structure of the solidified metal.

During solidification the total resistance to heat flow from the melt to the substrate (heat sink) is governed by the thermal resistances of the solidifying shell and the shell/substrate interface. Under the conditions of conventional continuously cast sections (slabs, blooms or billets), where solidification is completed in around 30 minutes, the heat transfer resistance is dominated by the solidifying shell resistance. However, our experimental work has demonstrated that under thin strip casting conditions, where solidification is completed in less than a second, the heat transfer resistance is dominated by the interface thermal resistance at the surface of the substrate.

The heat transfer resistance is defined as $$R_{(t)} = \frac{\Delta T_{(t)}}{Q_{(t)}}$$

where Q, ΔT and t are heat flux, temperature difference between melt and substrate and time, respectively.

Figure 3:
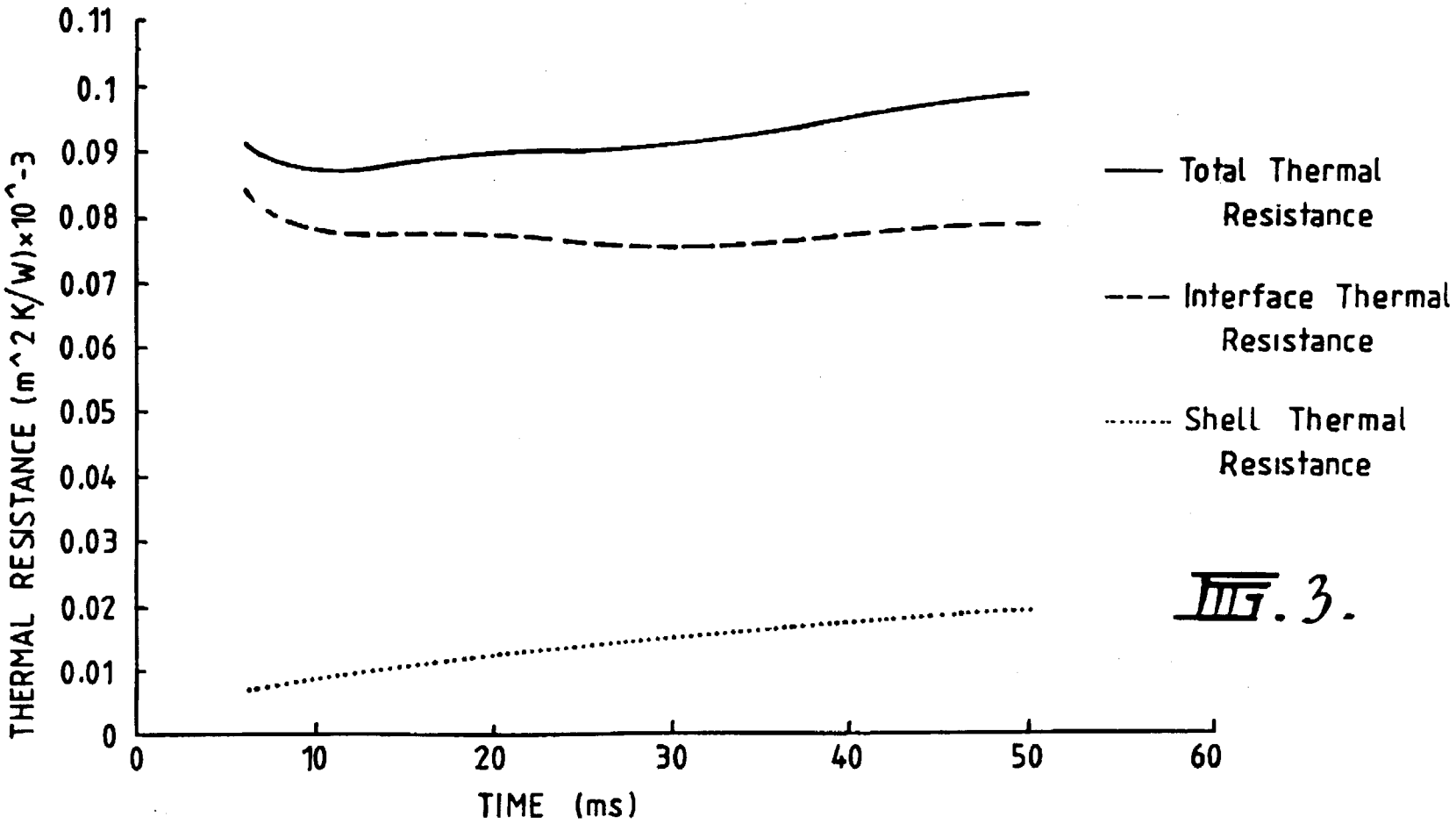
FIG. 3 illustrates thermal resistance values obtained during solidification of a typical steel sample in the experimental apparatus.

FIG. 3 illustrates thermal resistance values obtained during solidification of a typical MO6 steel sample in the test rig. This shows that the shell thermal resistance contributes only a small proportion of the total thermal resistance which is dominated by the interface thermal resistance. The interface resistance is initially determined by the melt/substrate interface resistance and later by the shell/substrate interface thermal resistance. Furthermore, it can be seen that the interface thermal resistance does not significantly change in time which indicates that it will be governed by the melt/substrate thermal resistance at the initial melt/substrate contact.

Figure 4:
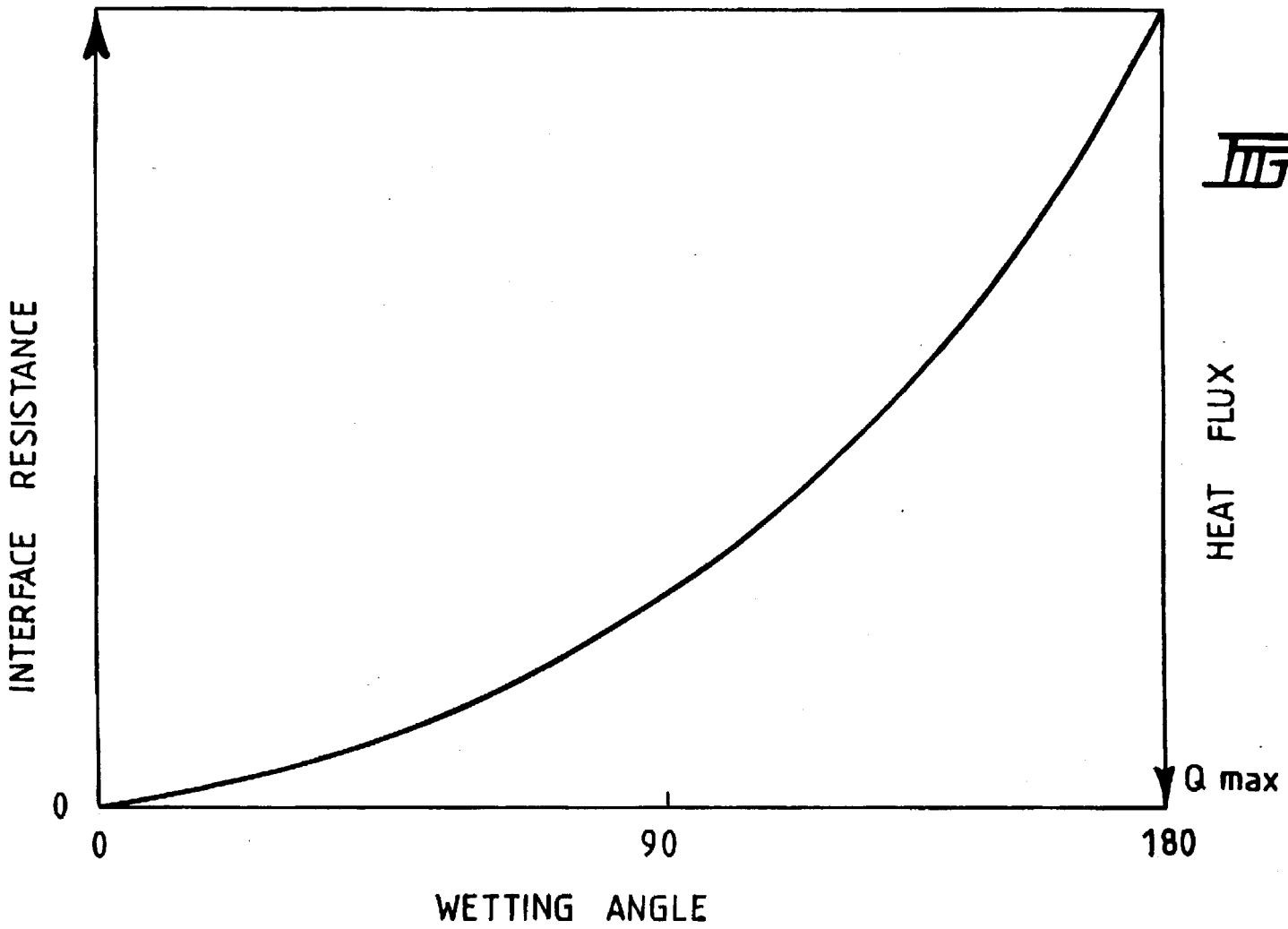
FIG. 4 illustrates the relationship between wettability of an interface layer and measured heat flux and interface resistance.

For a two-component system (melt and substrate), the melt/substrate interface resistance and heat flux are determined by the wettability of the melt on a particular substrate. This is illustrated in FIG. 4 which shows how interface resistance increases and heat flux decreases with increasing wetting angle which corresponds with reducing wettability.

The importance of wetting of the substrate by melt was demonstrated by the developmental work described in our aforesaid International Patent Application PCT/AU93/00593 which discloses application of vibratory movements. The application of vibratory movements was for the purpose of promoting wetting of the substrate and increasing the nucleation density for the melt solidification. The mathematical model described at page 10 of that case proceeded on the basis that full wetting was required and considered the vibrational energy required to achieve this. In the experimental work which verified this analysis it was shown that significant improvement in heat flux could not be obtained unless the substrate was smooth. More specifically, it is necessary for the substrate to have an Arithmetic Mean Roughness Value ($R_a$) of less than 5 microns in order to obtain adequate wetting of the substrate, even with the application of vibration energy. The same results apply to the application of the present invention, and is therefore necessary to have a smooth casting surface having an Arithmetic Mean Roughness Value ($R_a$) of less than 5 microns.

Figure 5:
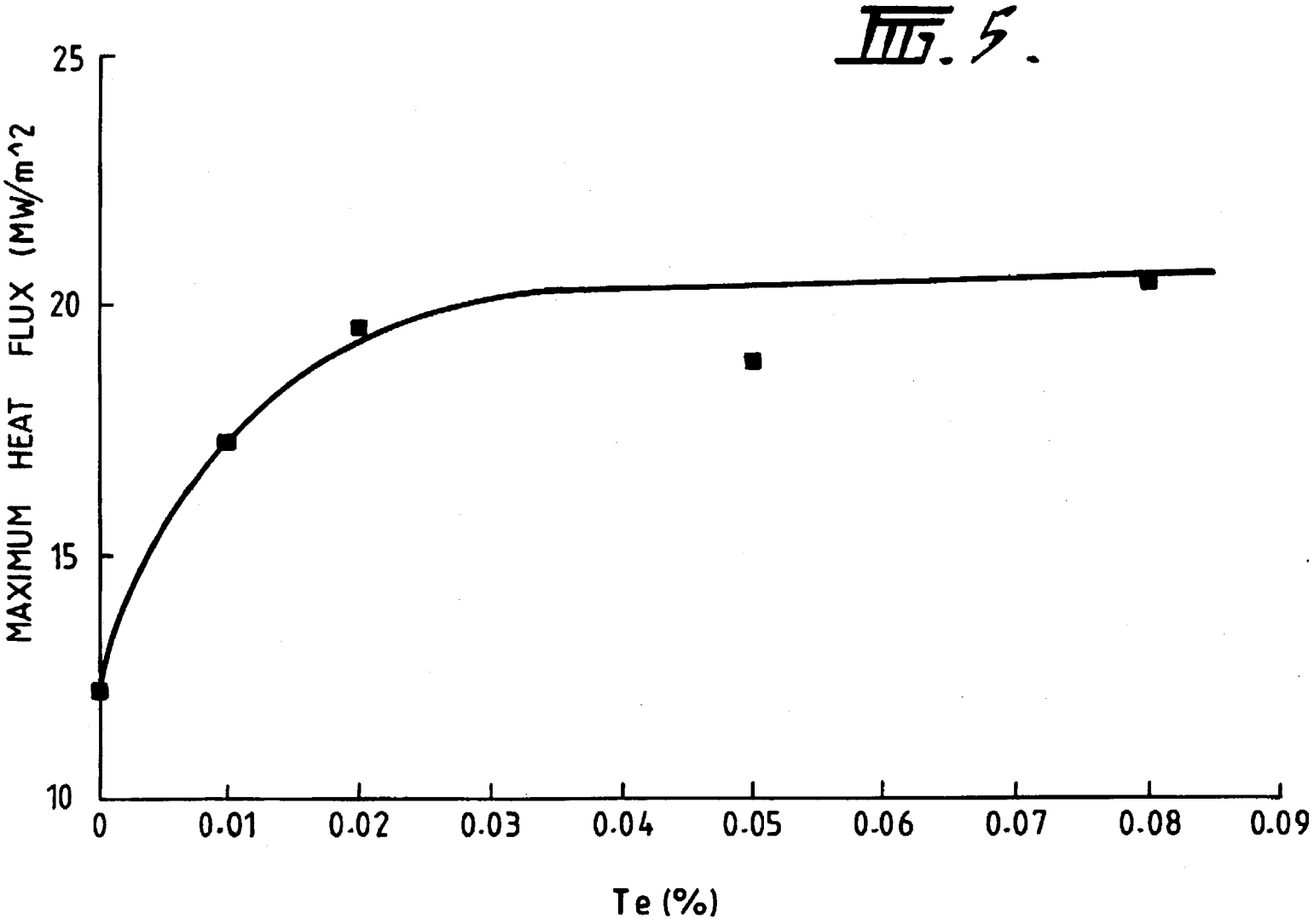
FIGS. 5, 5A and 6 illustrate variations in heat flux obtained by the additions of tellurium to stainless steel melts.

The importance of the wettability of the melt on the substrate and the need for a smooth substrate is confirmed by results obtained on solidification from melts containing additions of tellurium which is known to reduce the surface tension of iron. FIG. 5 illustrates maximum heat flux measurements obtained on solidification of stainless steel onto smooth chromium substrates from melts containing tellurium additions. It will be seen that the heat flux was strongly affected by the tellurium additions and was in fact almost doubled by tellurium additions of 0.04% of more.

Figure 6:
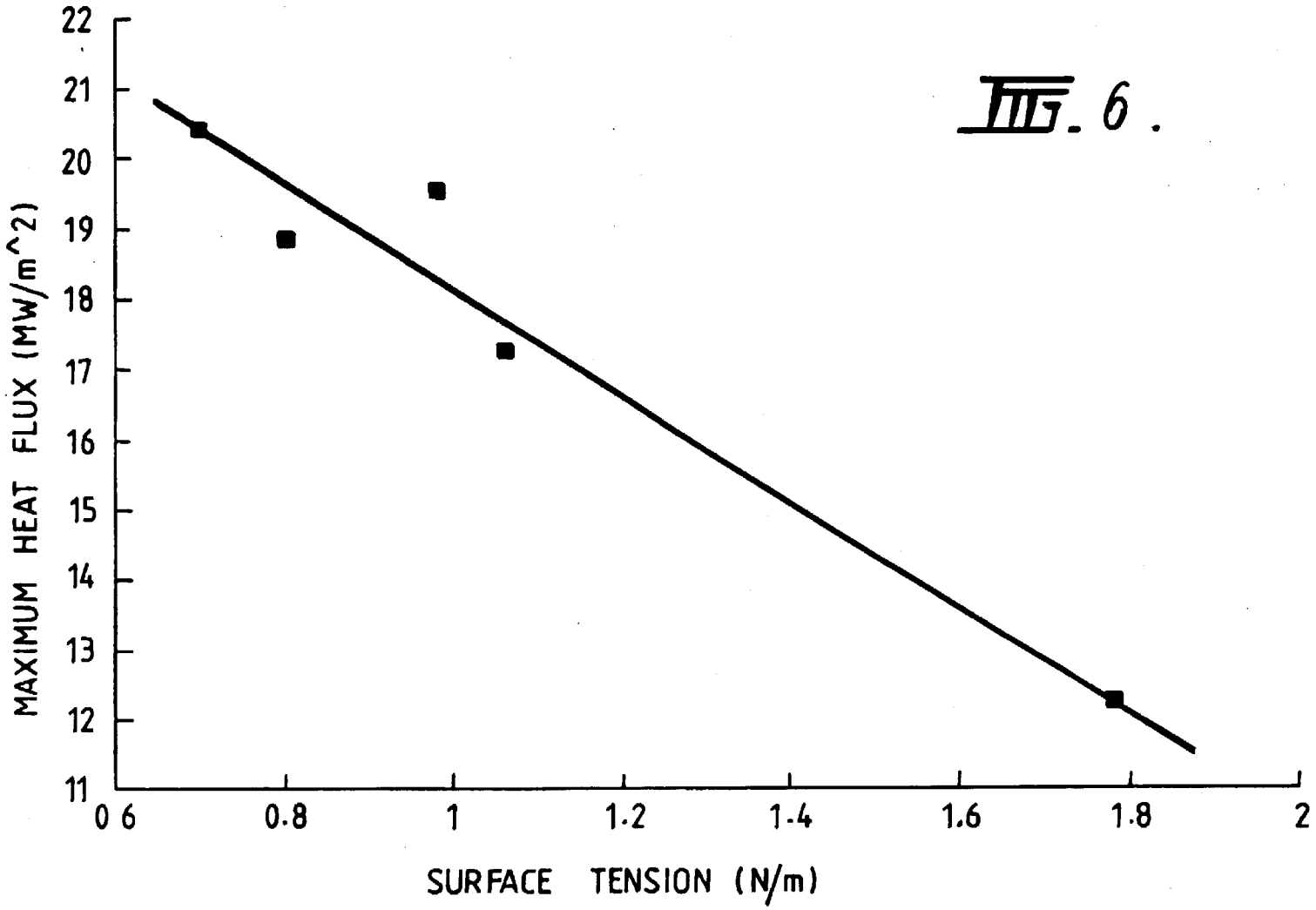

FIG. 6 plots maximum heat flux measurements against varying surface tension of the melt produced by the tellurium additions and it will seen that the heat flux increased substantially linearly with corresponding reductions in surface tension.

Figure 5A:
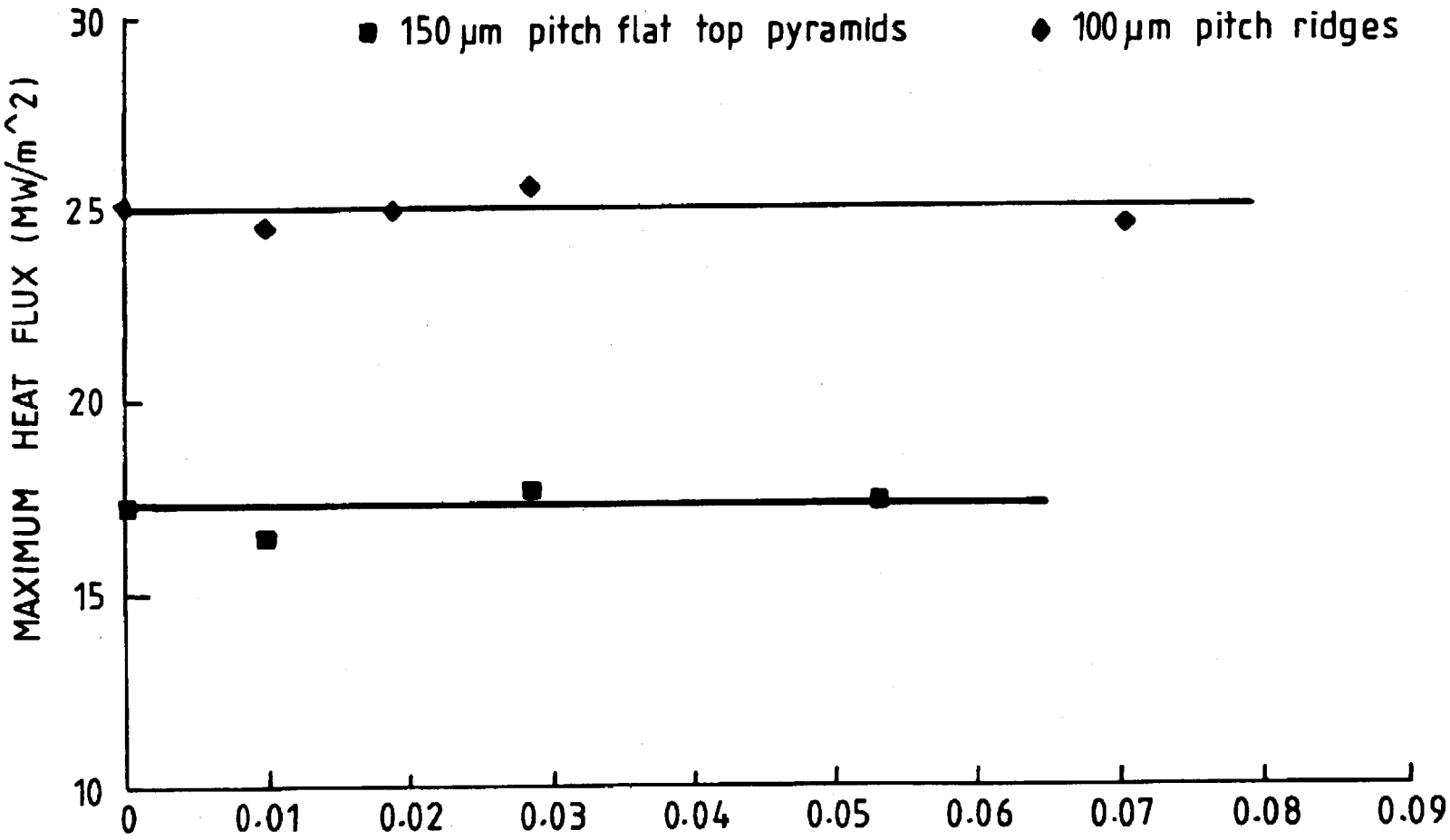

FIG. 5A illustrates maximum heat flux measurements obtained on solidification of stainless steel with tellurium additions onto chromium substrates with textured surface. The lower line shows the results for a textured surface having flat top pyramids at 150 microns pitch and the upper line shows the results for a surface textured by regular ridges at 100 microns pitch. It will be seen that in both cases the heat flux was unaffected by the tellurium additions. With a textured surface the nucleation density is established by the texture and heat flux cannot be dramatically improved by enhanced wettability of the melt whereas a significant improvement can be obtained on a smooth substrate.

Figure 7:
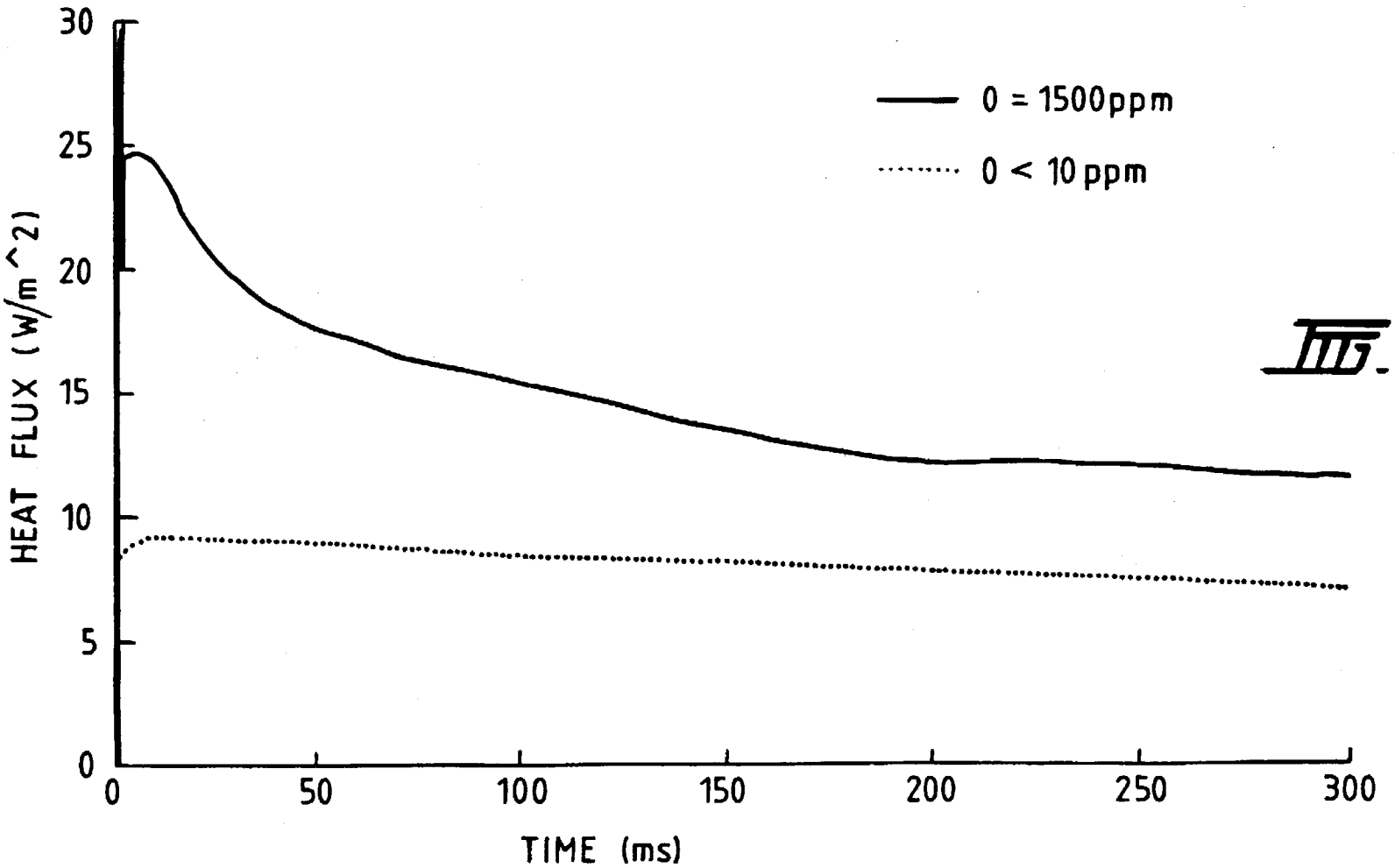
FIG. 7 illustrates typical heat flux values obtained on solidification of electrolytic iron with and without oxygen addition.

The significance of wettability of the melt on the substrate has been further demonstrated by examining the effect of oxygen additions on the resulting heat flux. Oxygen is surface active and is known to reduce the surface tension of iron, although not to the same degree as tellurium. FIG. 7 illustrates typical heat flux values obtained on solidification of electrolytic iron with and without oxygen addition. It will be seen that the heat flux is dramatically increased by the oxygen addition, particularly in the early stages of the solidification process.

The test results described thus far were obtained from strictly controlled two component melt and substrate systems. Usually a third component is present at the melt/substrate interface in the form of oxides. These oxides are most likely originated at the melt surface and subsequently deposited on the substrate surface as a thin film. When casting steel in a strip caster such oxides will generally be present as slag floating on the upper surface of the casting pool and are deposited on the casting surface as it enters the pool. It is generally been considered necessary when casting steel in a twin roll caster to brush or otherwise clean the casting rolls to avoid the build up of oxides which have been recognised as contributing to thermal resistance and causing significant reduction in heat flux and solidification rates.

Figure 8:
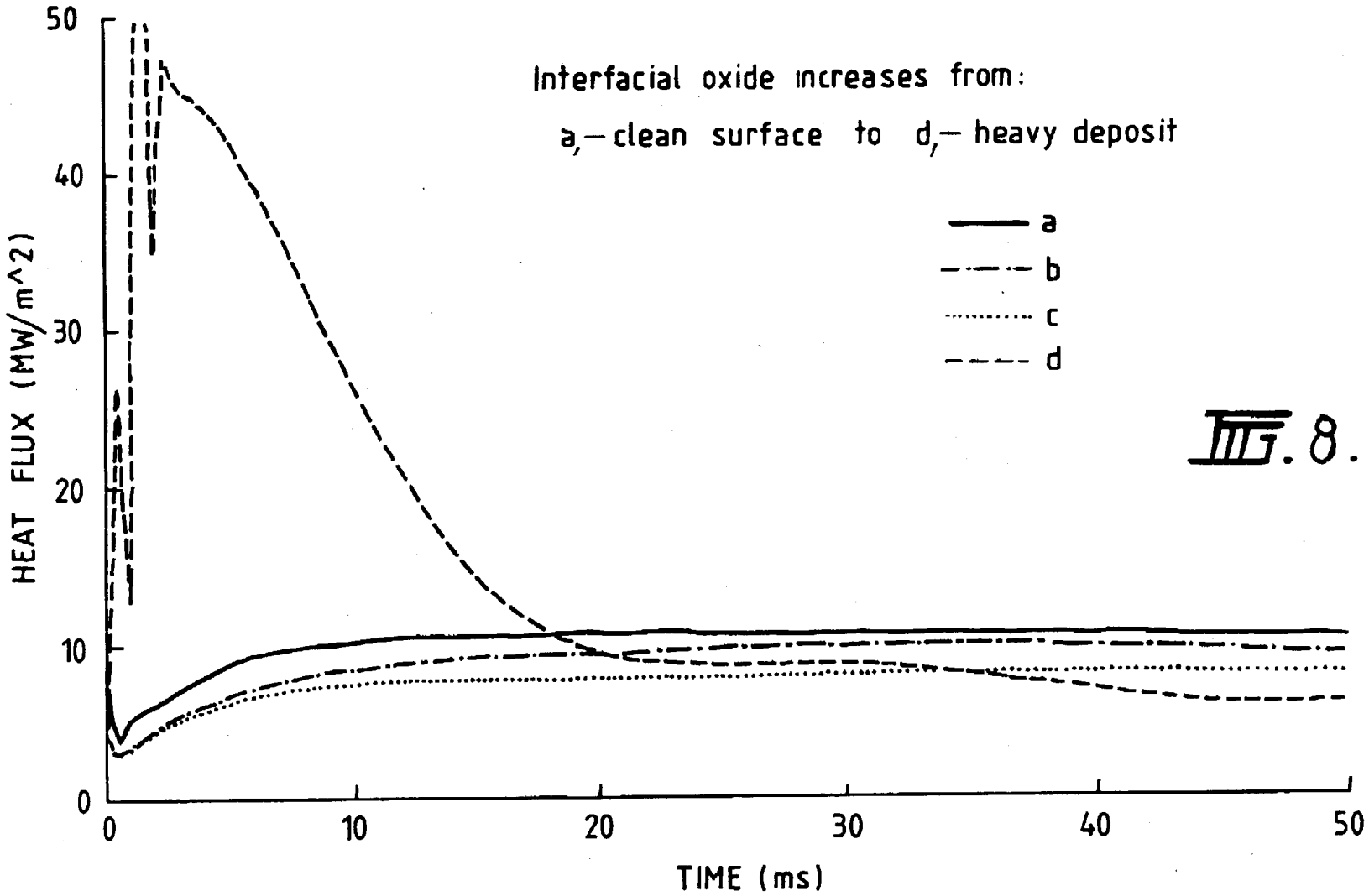
FIGS. 8 and 9 illustrates the results of tests in which oxide film was allowed to build up gradually during successive oxide immersions.

In order to examine the effect of oxide build up on the substrate, oxide film was allowed to build up gradually during successive substrate immersions in a stainless steel melt and heat flux measurements were taken on solidification during each immersion. FIG. 8 illustrates results obtained from these experiments. Initially the build up of oxides produced a progressive reduction in measured heat flux. However, when the oxide layer exceeded approximately 8 microns in thickness, a very large initial increase in heat flux was observed followed by a sharp reduction. Examination of the oxide surface revealed signs of melting and coalescence into coarser oxide grains. The oxide layer was found to be mainly composed of manganese and silicon oxides.

Figure 9:
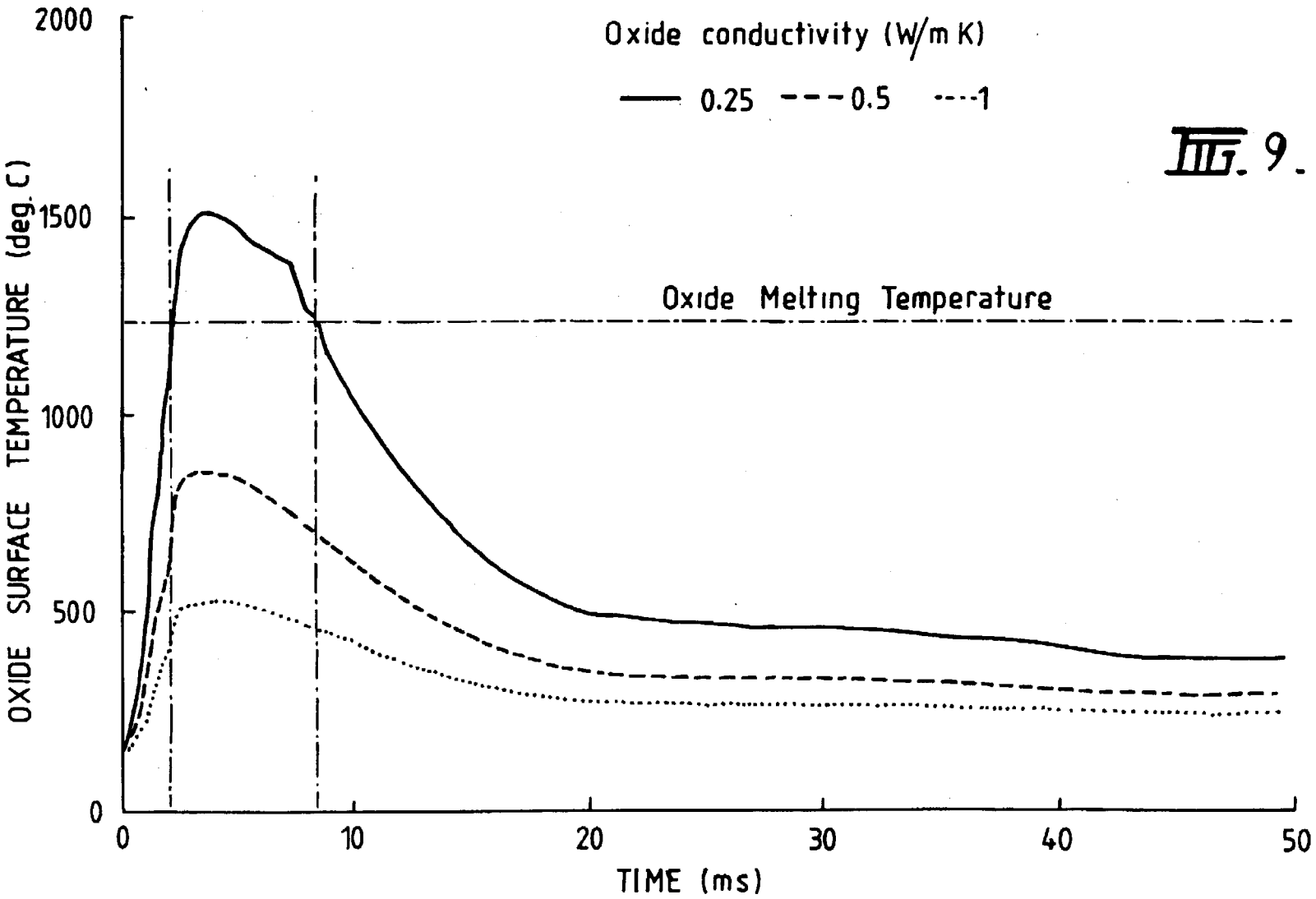
Figure 10:
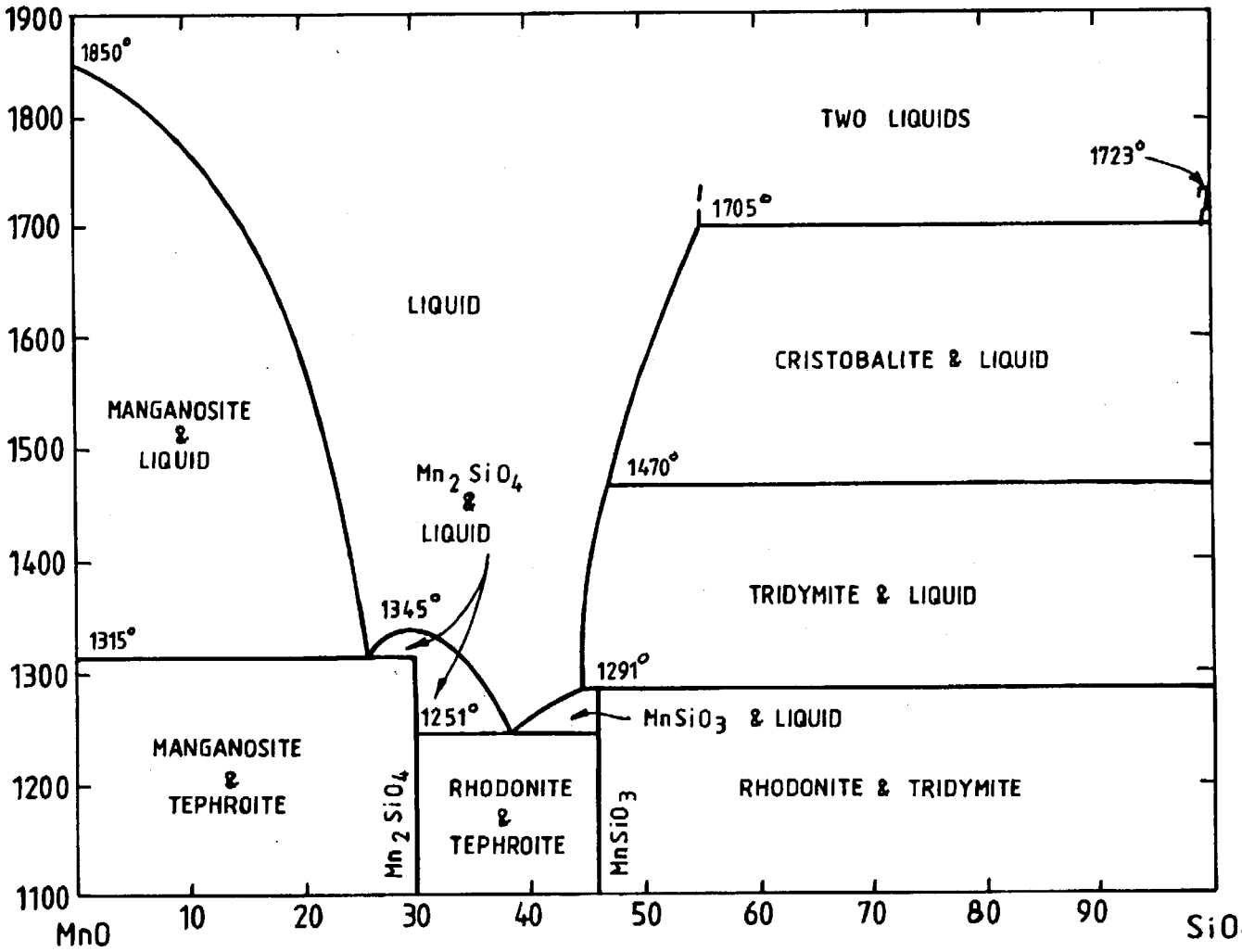
FIG. 10 is a phase diagram for Mn-SiO mixtures.

The Mn-$SiO_2$ phase diagram presented in FIG. 10 (Glasser [1958]) shows that for a full range of compositions, some liquid is present above 1315° C. and that in the eutectic region melting can start from 1251° C. Mathematical analysis of the results obtained on solidification of the stainless steel on a substrate with a heavy oxide deposit as represented in FIG. 8 showed that at the early stages of melt/substrate contact the surface of the oxide layer reached high enough temperatures to melt and remain molten for a period of 7 to 8 milliseconds as illustrated in FIG. 9. This period corresponded to the period of increased heat flux indicated in FIG. 8 and demonstrates that the increased heat flux was due to presence of a partially liquid layer at the substrate/melt interface at this period.

In view of the demonstrated importance of wettabillty at the melt/substrate interface it was concluded that the melting of the manganese and silicon oxides produced improved wettability so as to increase the heat flux at the relevant time.

Figure 11:
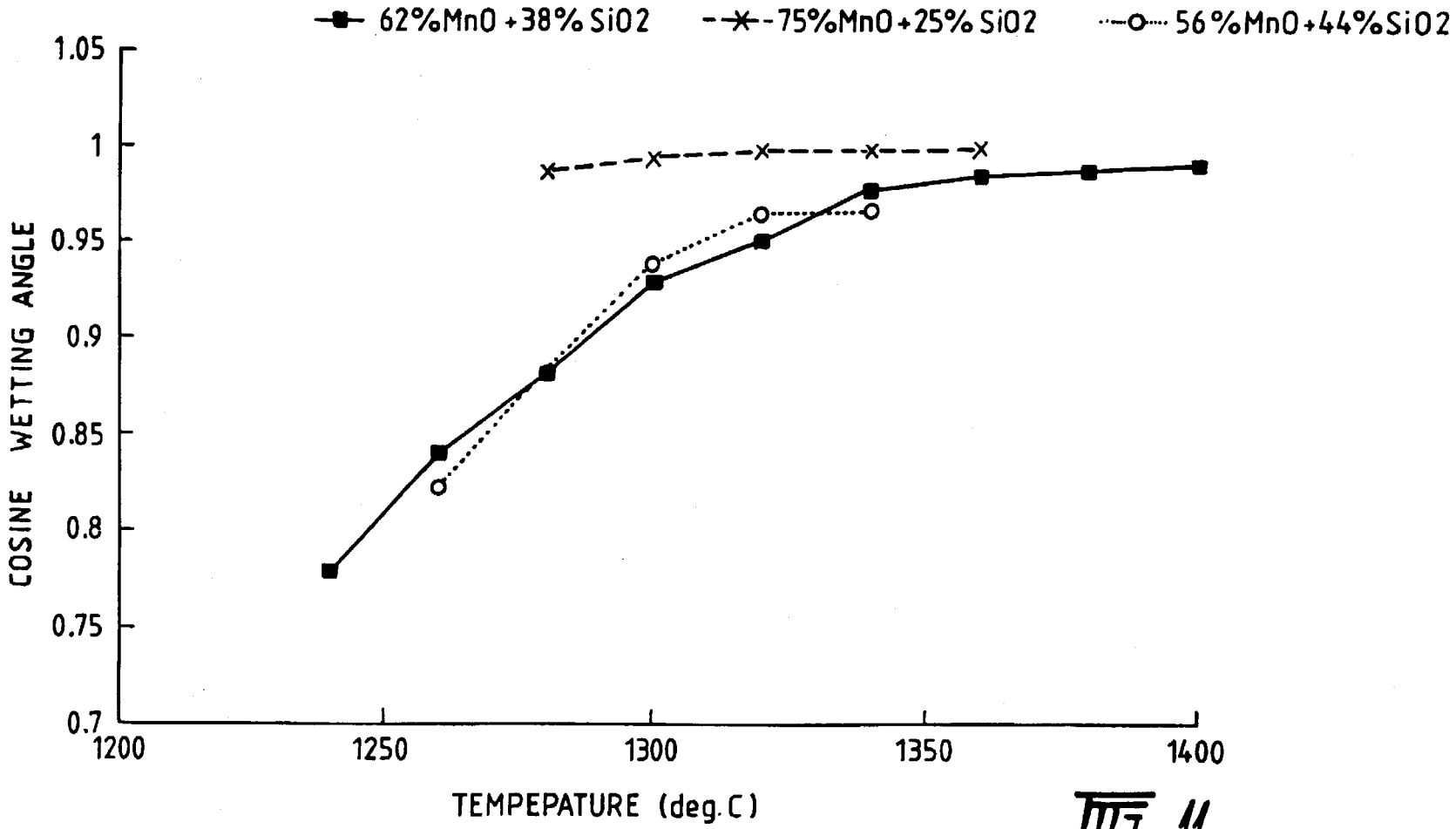
FIG. 11 shows wetting angle measurements for various manganese and silicon oxide mixtures.

This conclusion was tested by measuring the wettability of various manganese and silicon oxide mixtures on a Cr substrate. The results of these measurements are illustrated in FIG. 11 which shows that at typical temperatures between 1250° and 1400° C. mixtures of MnO and $SiO_2$ of varying proportions all exhibit good wetting angle measurements. A mixture of the proportions 75% MnO and 25% $SiO_2$ exhibits particularly good wettability on a Cr substrate. This result is consistent with the proposition that if a mixture of MnO and $SiO_2$ is present at temperatures at which this mixture melts, this particular molten mixture will enhance wettability at the substrate interface with consequent dramatic improvement in total heat flux.

It should be observed that all of the melting angle measurements exhibited in FIG. 11 represent very good wetting indeed. The highest melting angle observed was slightly less than 40° and the majority were much less than this. These results show that by appropriately choosing the proportions of silicon and manganese it is possible to produce a dramatic transition from very poor wettability to extremely good wettability with melting angles of less than 40°.

Figure 12:
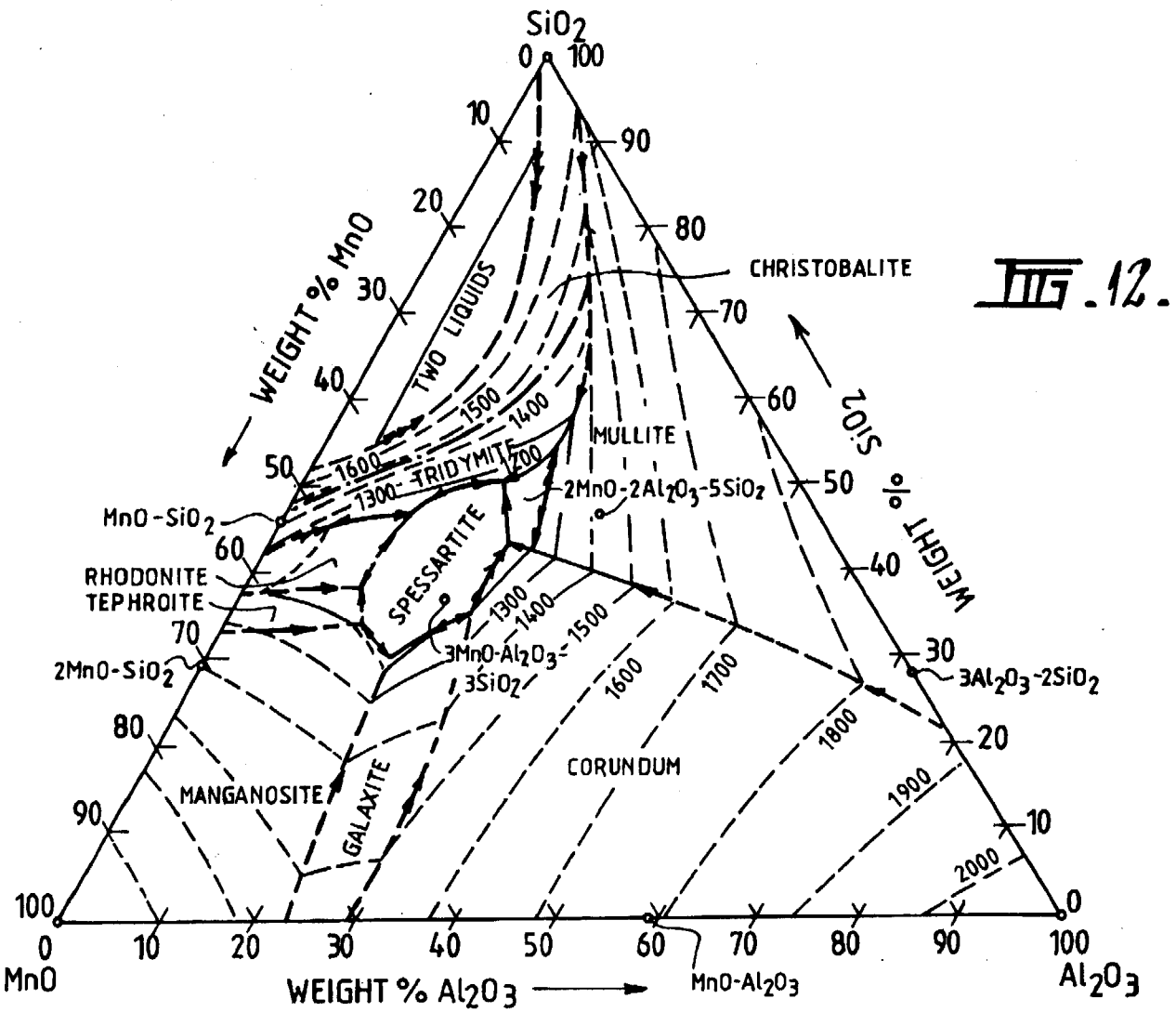
FIG. 12 is a three-component phase diagram for manganese, silicon and aluminium oxide mixtures.

When casting steels the melt will usually contain aluminium as well as manganese and silicon and accordingly there will be a three phase oxide system comprising MnO, $SiO_2$ and $Al_2O_3$. In order to determine the melting temperature of the oxides it is therefore necessary to consider the three-component phase diagram as illustrated in FIG. 12.

Figure 13:
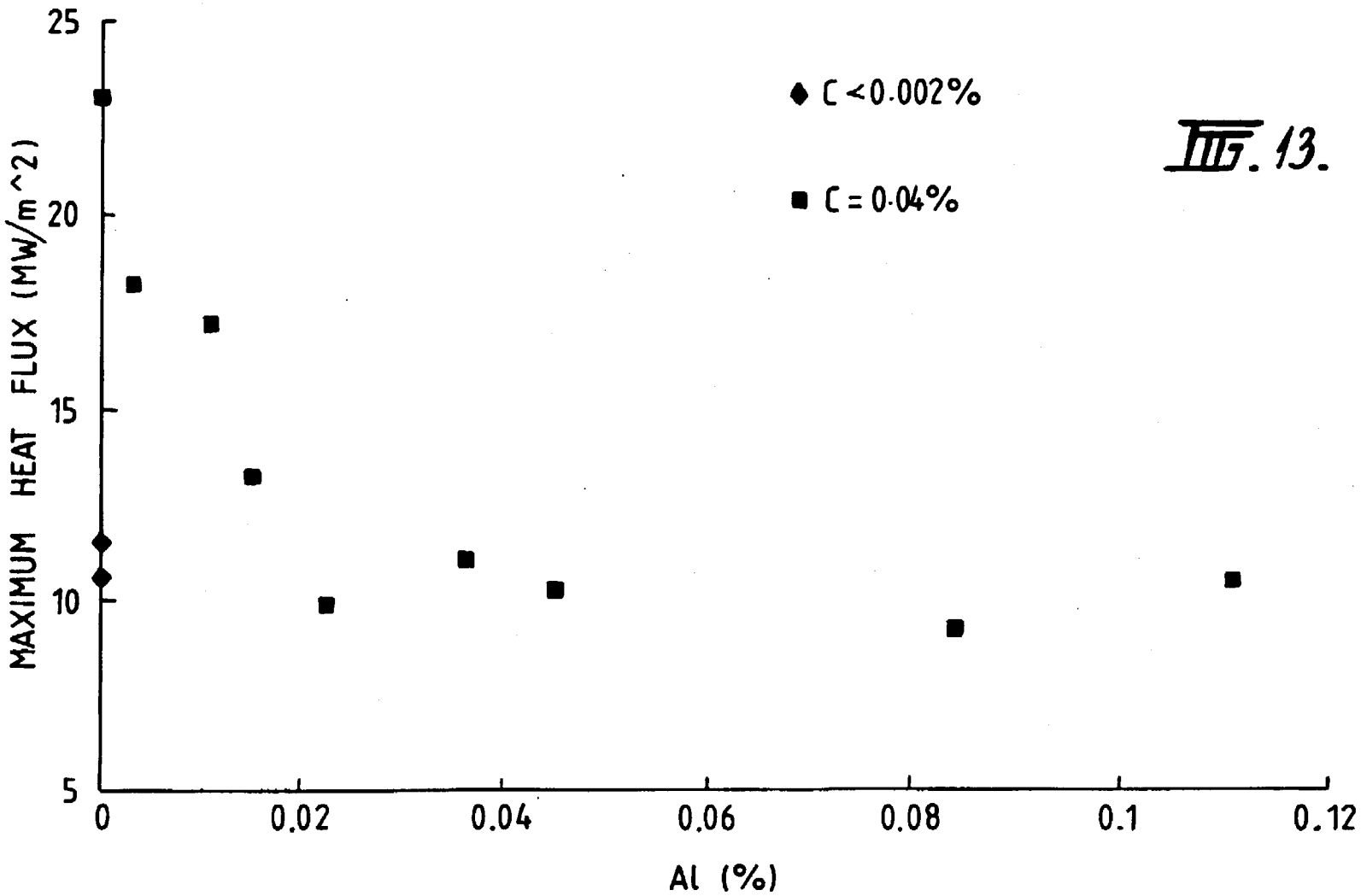
FIGS. 13 and 14 illustrate the effect of varying aluminium content on solidification from a steel melt.
Figure 14:
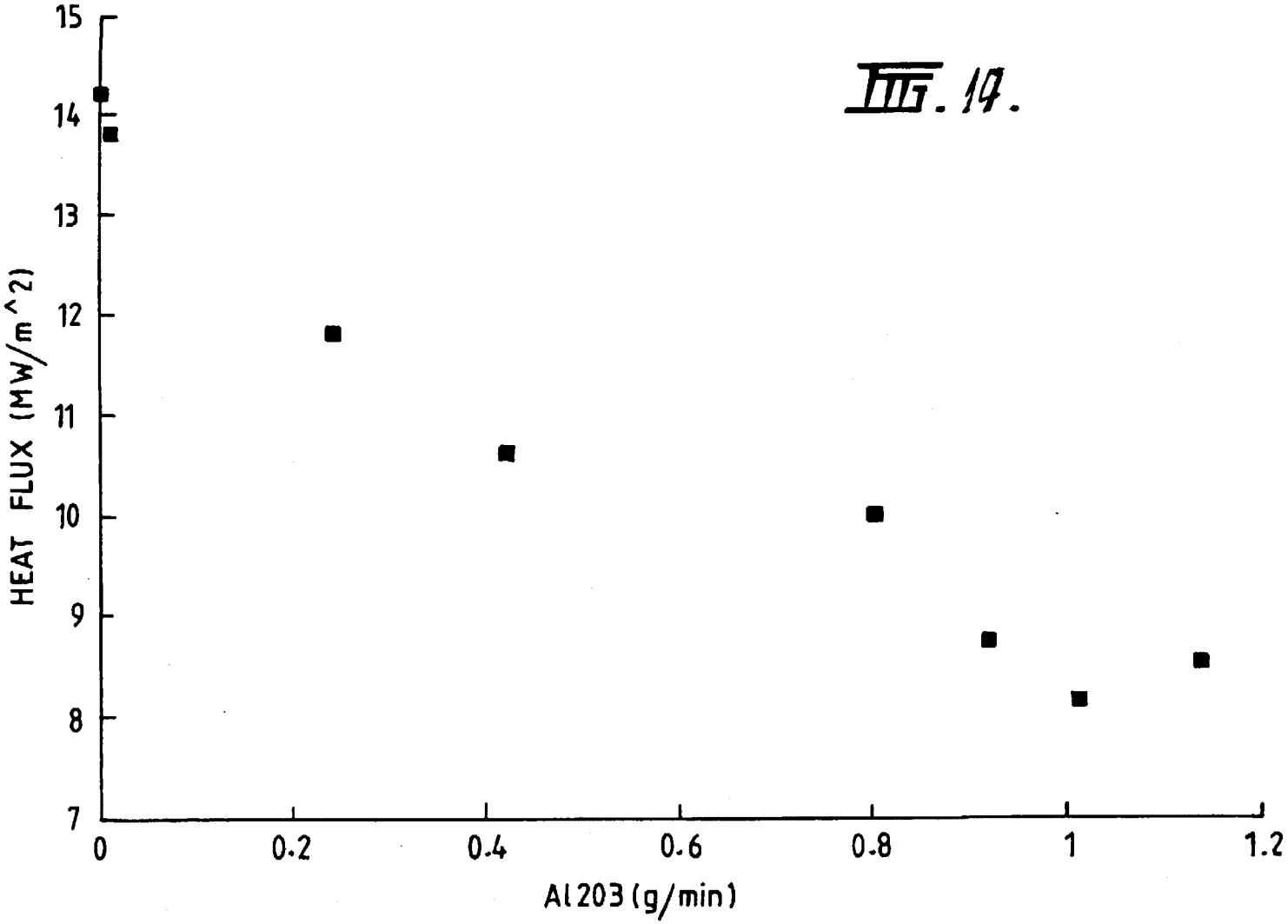

Our experimental work has shown that total heat flux obtained on solidification reduces with increasing aluminium content of the melt as illustrated by FIG. 13. The reduction in heat flux is caused by the formation of $Al_2O_3$ during solidification as illustrated in FIG. 14.

From the above results it appears that increased heat flux can be obtained if a partially liquid oxide layer is present on the substrate, particularly a layer of MnO and $SiO_2$ and if the formation of $Al_2O_3$ can be minimised.

In order to test this, the effect of oxygen blowing on a typical MO6 melt was investigated since the presence of oxygen is such as to affect the slag liquidus temperature. Oxygen has a very strong affinity for iron and the transient effect of increasing the availability of free oxygen is to produce much more iron oxide than would be achieved under equilibrium conditions. This has the effect of lowering the melting temperature of the oxide layer with the result that the oxide layer is more likely to be liquid during casting conditions. The presence of free oxygen also increases the production of MnO and $SiO_2$ in proportions closer to a eutectic composition which will also enhance the formation of a liquid oxide layer at typical casting temperatures.

Figure 15:
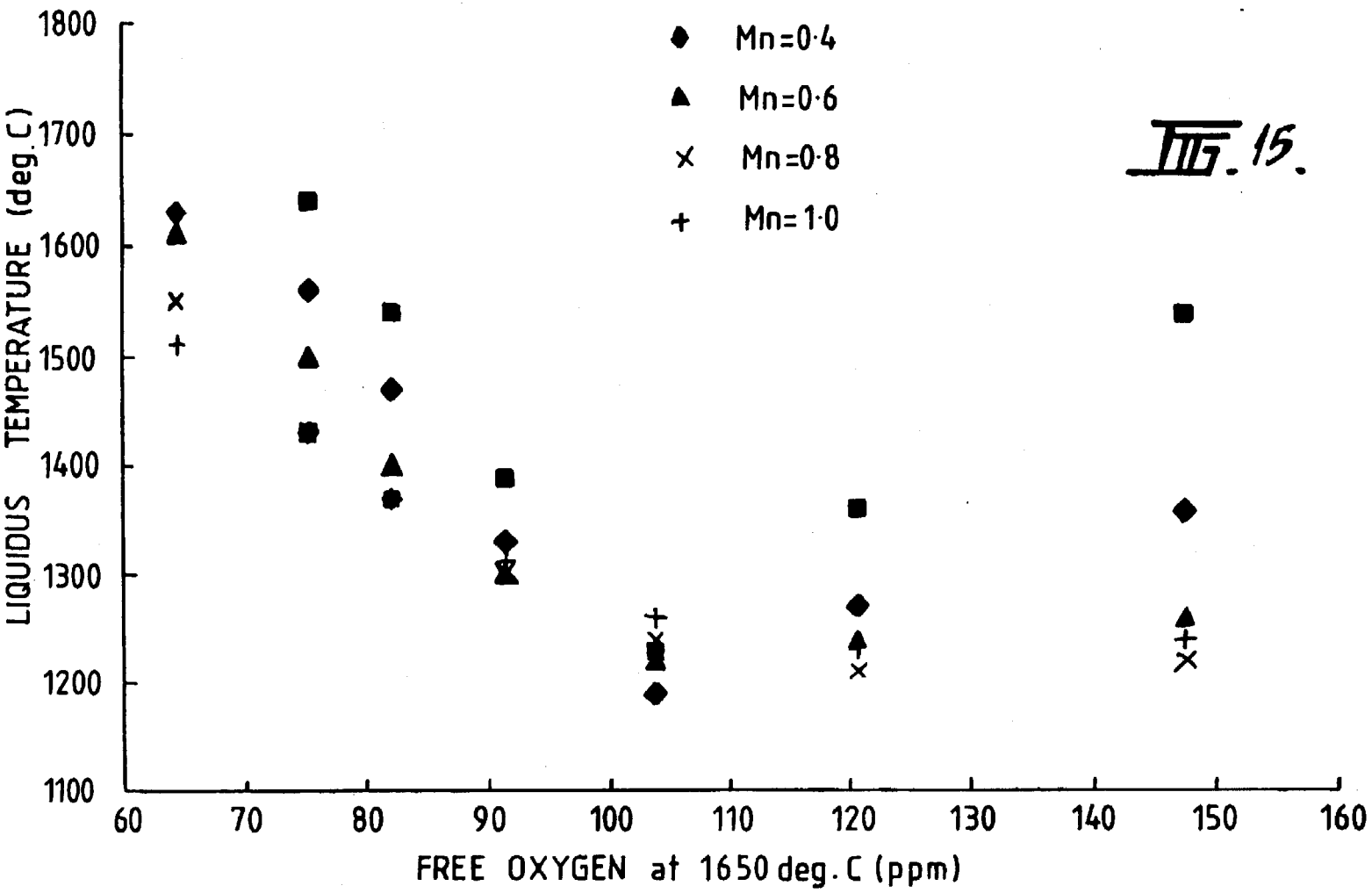
FIG. 15 illustrates the effect of free oxygen on the slag liquidus temperature of steel melts.

The effect of free oxygen in the melt on the slag liquidus temperature of typical MO6 steels of varying manganese content at a temperature of 1650° C. is illustrated in FIG. 15. These results show that the liquidus temperature of the slag can be minimised by controlling the availability of free oxygen at a relevant casting temperature. Examination of the surface microstructure of samples solidified under these varying conditions showed that there was enhanced formation of MnO and $SiO_2$.

Figure 16:
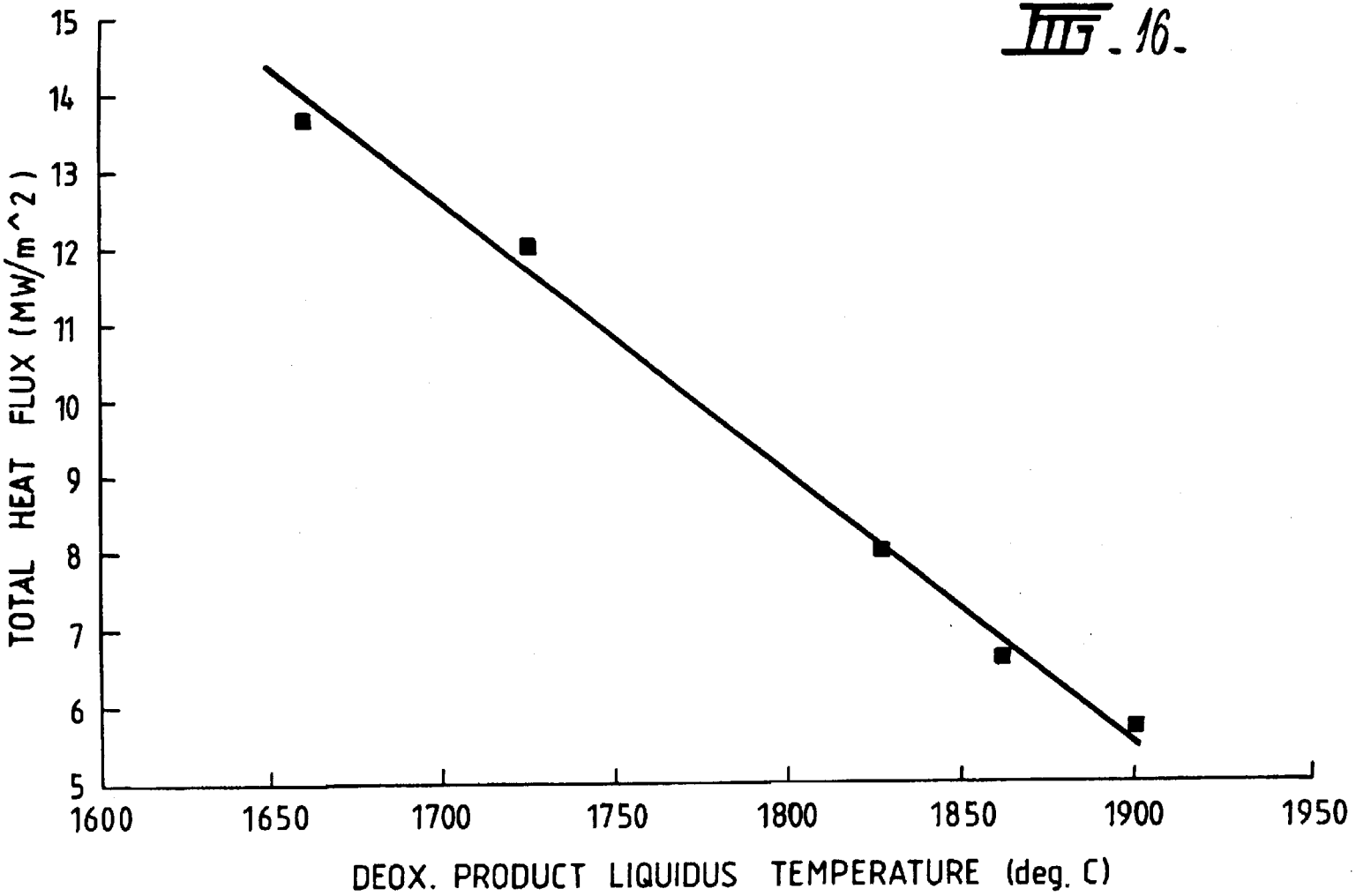
FIG. 16 illustrates the manner in which total heat flux achieved in the solidification of steel specimens was related to the liquidus temperature of the steel deoxidation products.
Figure 17:
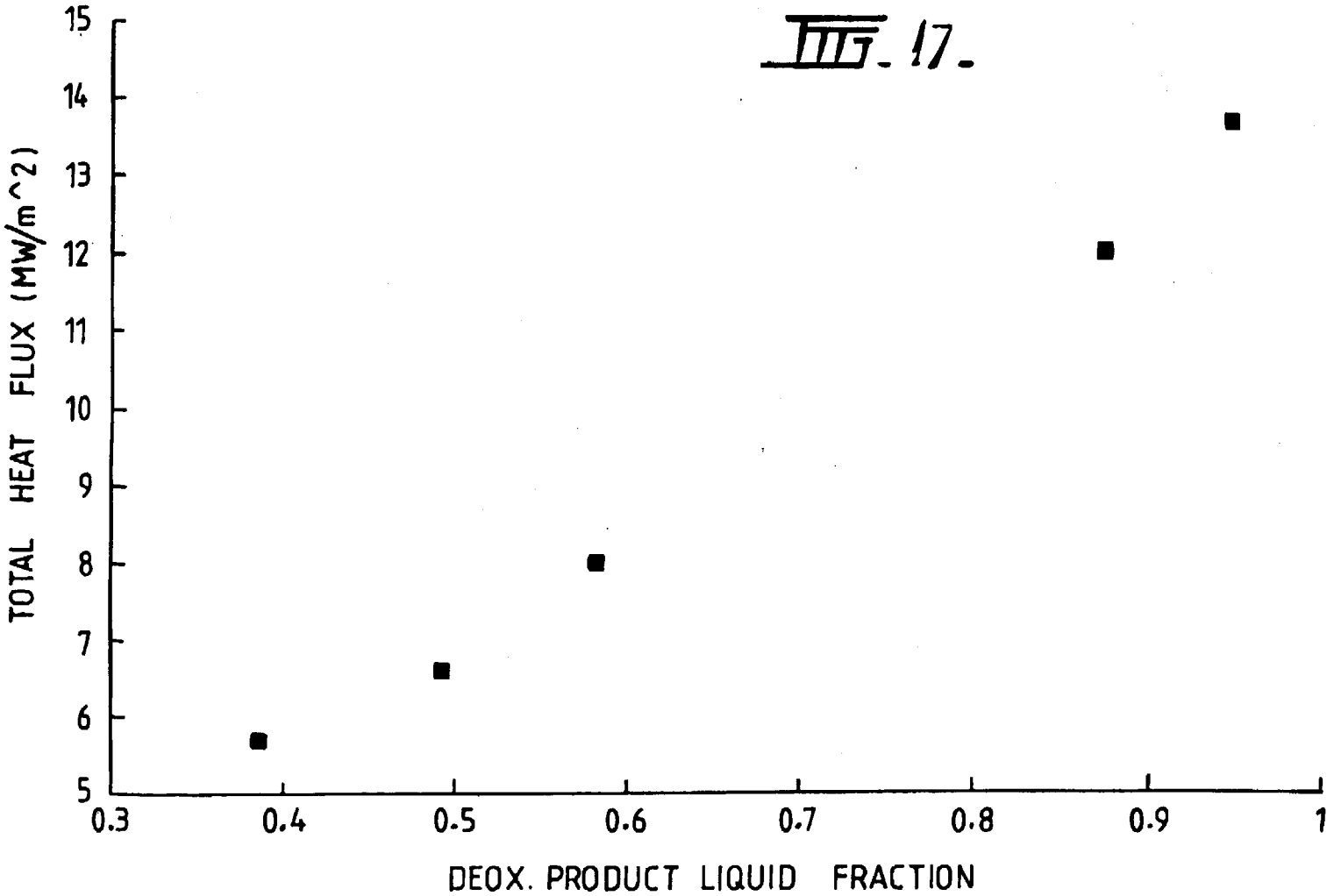
FIG. 17 illustrates an important relationship between the total heat flux obtained on solidification of steel specimens and the proportions of the steel deoxidation products which became liquid during the solidification process.

FIG. 16 illustrates the manner in which total heat flux was related to the deoxidation product liquidus temperature. It will be seen that the total heat flux increases substantially linearly with decreasing liquidus temperatures of the deoxidation products. In steel melts the deoxidation products comprise FeO, MnO, $SiO_2$ and $Al_2O_3$ which throughout the casting temperature range will at best be a liquid/solid mixture. We have determined that there is a very important correlation between the liquid fraction of oxides and the total heat flux during the solidification process. FIG. 17 presents total heat flux measurements obtained on solidification of steel specimens plotted against the proportion of the deoxidation products which was liquid during the solidification process. In these tests the melt temperature was 1620° C. It will be seen that for this temperature there is a quite precise relationship between the measured heat flux and the fraction of the deoxidation products which was liquid at that temperature. The correlation holds for other temperatures within the normal working range of melt temperatures extending from 1900° C. to 1400° C.

The experimental results described thus far establish that heat flux on solidification can be significantly increased by ensuring that there is interposed between the melt and the solidification substrate a layer of material which is at least partly liquid, which initially improves wettability of the melt on the substrate and which subsequently improves wettability between the substrate and solidified shell interface. When casting steel, the interface layer may be formed from steel deoxidation products in the form of a mixture of oxides which will at least partially melt. The proportion of the deoxidation products such as FeO, MnO, $SiC_2$ and $Al_2O_3$ can be adjusted to ensure that the liquidus temperature of the mixture is reduced to such a degree that there will be substantial melting of the mixture at the casting temperature and there is an important relationship between the fraction of the mixture which is liquid during solidification and the total heat flux obtained on solidification. The proportions of the oxides in the mixture and the liquidus temperature of the mixture can be affected by supply of oxygen to the melt during solidification and in particular the liquidus temperature may be reduced so as to enhance the heat flux obtained. This may be of particular advantage in the casting of manganese-silicon killed steels such as MO6 grades of steel.

Aluminium killed steel such as AO6 steel present particular problems in continuous strip casting operations, especially in twin roll casters. The aluminium in the steel produces significant quantities of $Al_2O_3$ in the deoxidation products. This oxide is formed as solid particles which can clog the fine passages in the distribution nozzle of a twin roll caster. It is also present in the oxide layer which builds up on the casting surfaces and causes poor heat transfer and low total heat flux on solidification. We have determined that these problems can be alleviated by addition of calcium to the melt so as to produce CaO which in conjunction with $Al_2O_3$ can produce liquid phases so as to reduce the precipitation of solid $Al_2O_3$. This not only reduces clogging of the nozzles but improves wettability of the substrate in accordance with the present invention so as to enable higher heat flux to be achieved during the solidification process.

Figure 18:
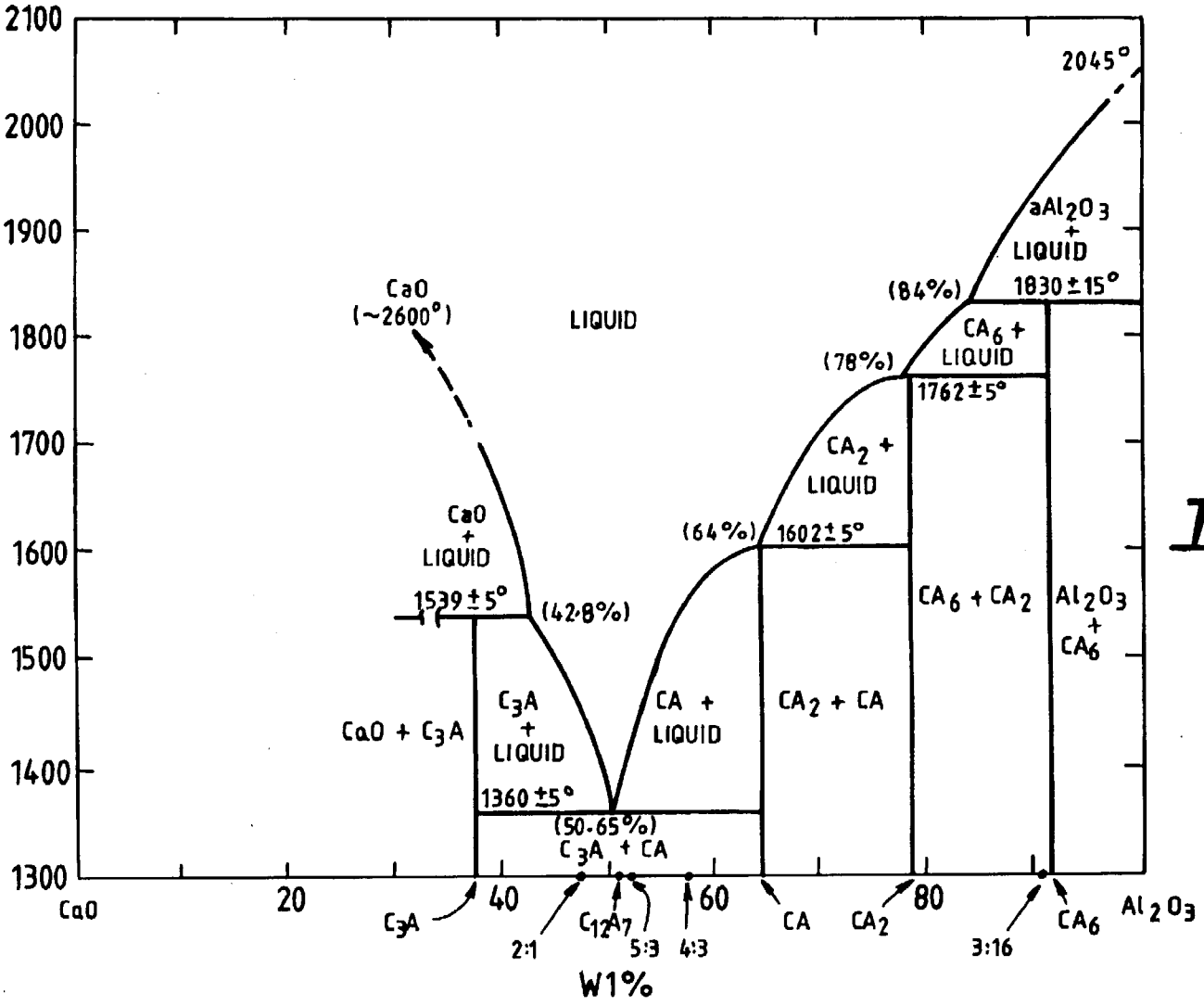
FIG. 18 is a phase diagram for $CaO-Al_2O_3$ mixtures.

FIG. 18 shows the phase diagram of CaO-$Al_2O_3$ mixtures and it will be seen that the eutectic composition of 50.65% CaO has a liquidus temperature of 1350° C. Accordingly if the addition of calcium is adjusted to produce a CaO-$Al_2O_3$ mixture of around this eutectic composition, this will significantly increase the liquid fraction of the oxide layer so as to enhance total heat flux.

Figure 19:
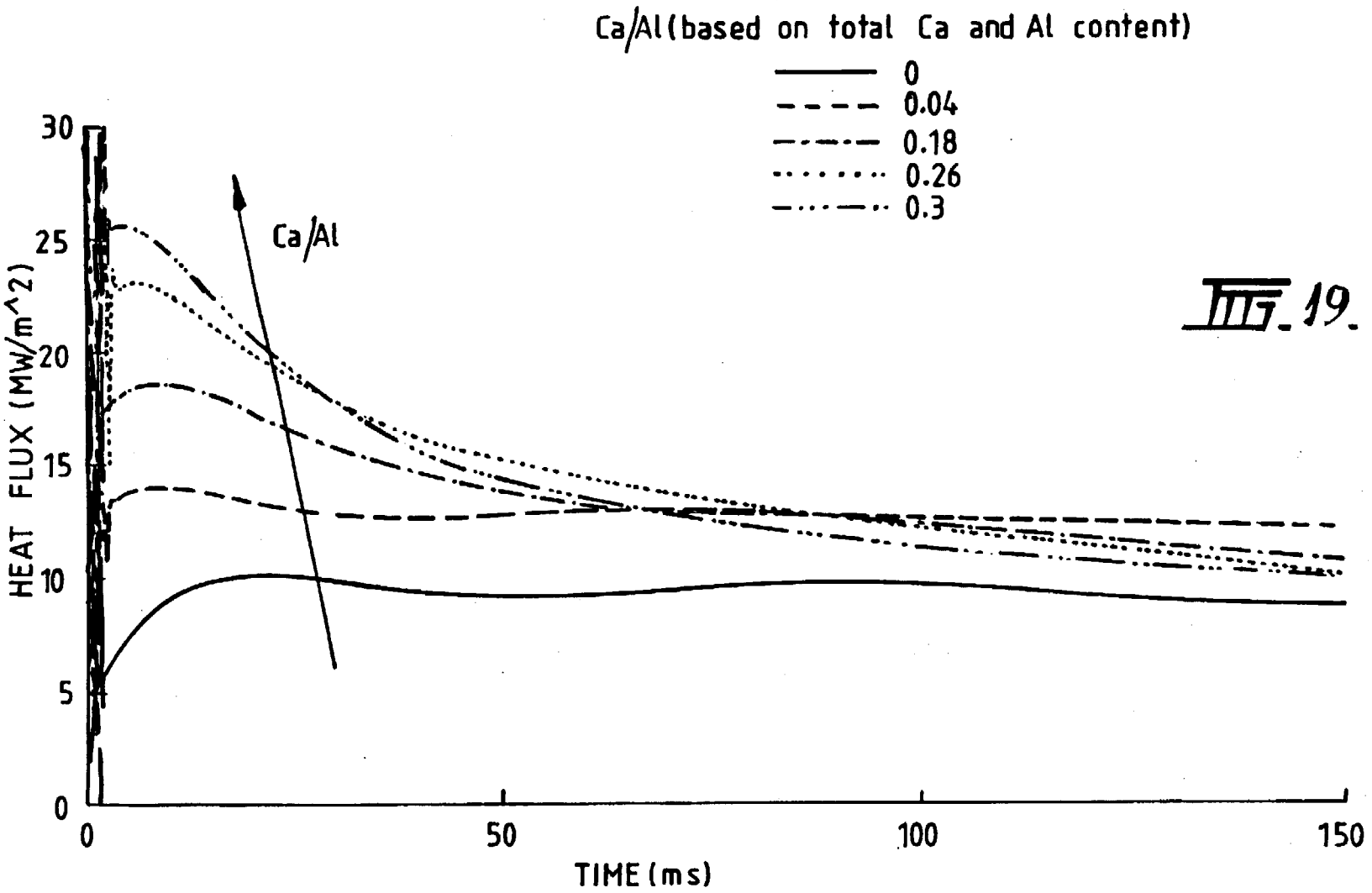
FIGS. 19 and 20 show the results of calcium additions on solidification of specimens from AO6 steel melts.
Figure 20:
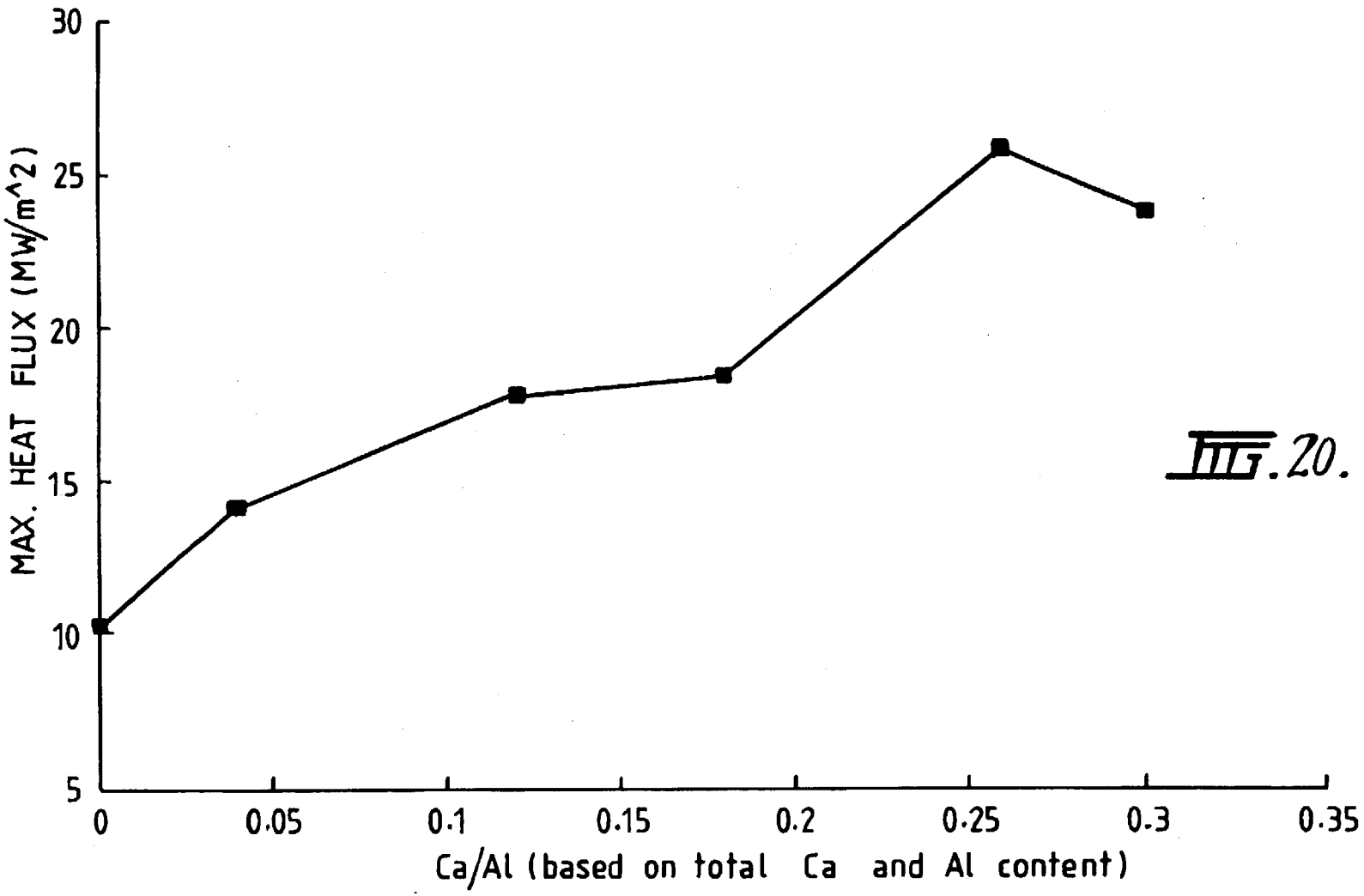

We have carried out solidification tests on a large number of AO6 steel specimens with varying calcium additions on a smooth substrate at a melt temperature of 1595° C. Results of these tests are shown in FIGS. 19 and 20. FIG. 19 plots the measured heat flux values over the period of solidification for varying calcium additions. Specifically five separate curves are shown for increasing Ca/Al compositions in the direction indicated by the arrow. FIG. 19 plots the maximum heat flux obtained in each solidification test against the Ca/Al content.

The results displayed in FIGS. 19 and 20 show that significant increases of heat flux can be obtained by increasing the Ca/Al content so that the $CaO-Al_2O_3$ mixture is close to its eutectic. Preferably, the proportion of calcium to aluminum in the melt is in the range of 0.2 to 0.3 by weight.

Our experimental work has shown that the substantially liquid oxide layer which covers the substrate under strip cooling conditions is very thin and in most cases is of the order of 1 micron thick or less. In the tests carried out the experimental apparatus illustrated in FIGS. 1 and 2, examination of the substrate and cast specimen surfaces after casting have revealed that both the substrate and cast surface have particles of manganese and silicon compositions which must have solidified from the liquid layer. On each surface these particles have been at sub-micron levels indicating that the thickness of the liquid layer is of the order of 1 micron or less.

Figure 21:
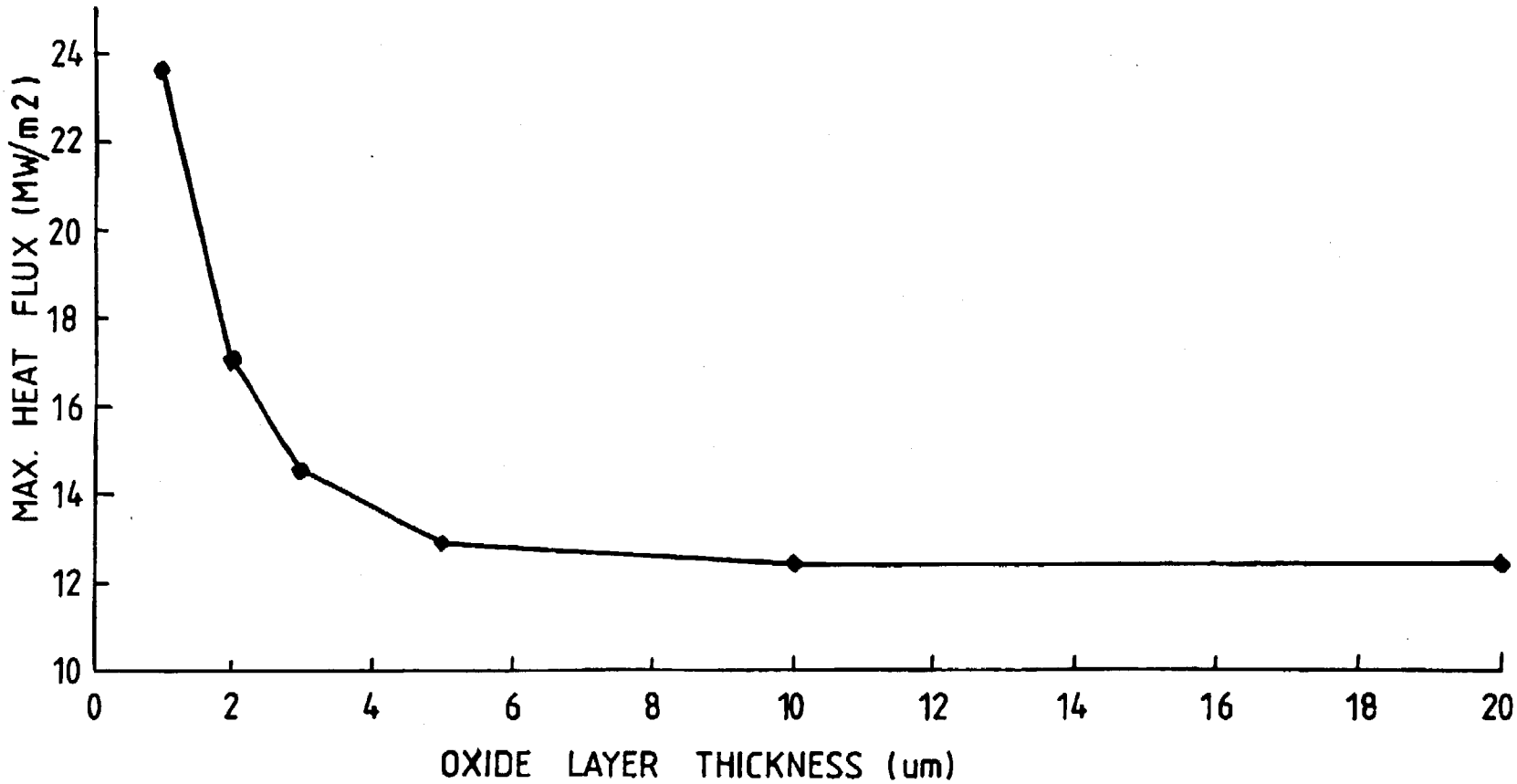
FIG. 21 illustrates the results of model calculations on the effect of the thickness of the surface layer.
Figure 22:
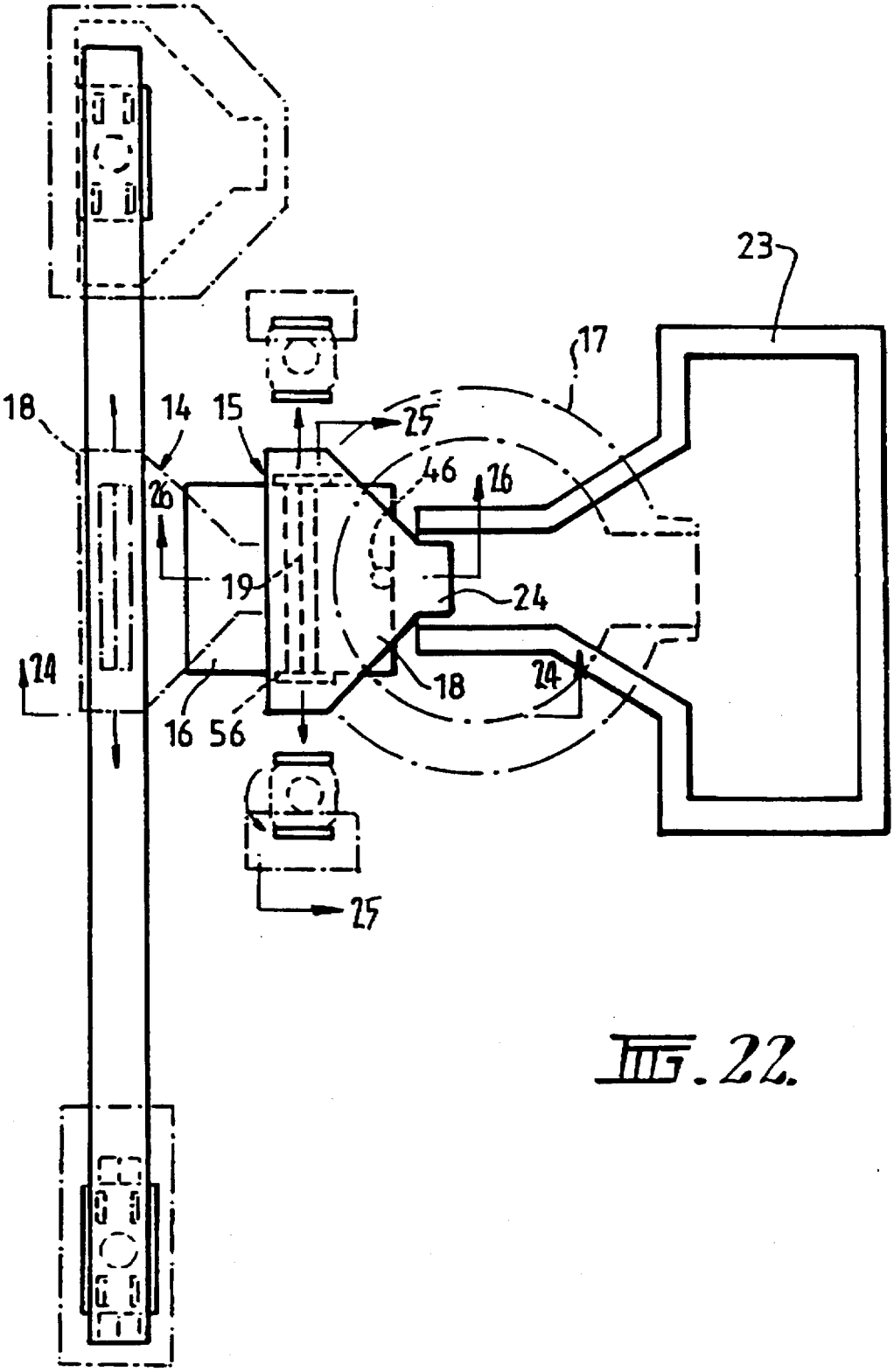
FIG. 22 is a plan view of a continuous strip caster which is operable in accordance with the invention.
Figure 23:
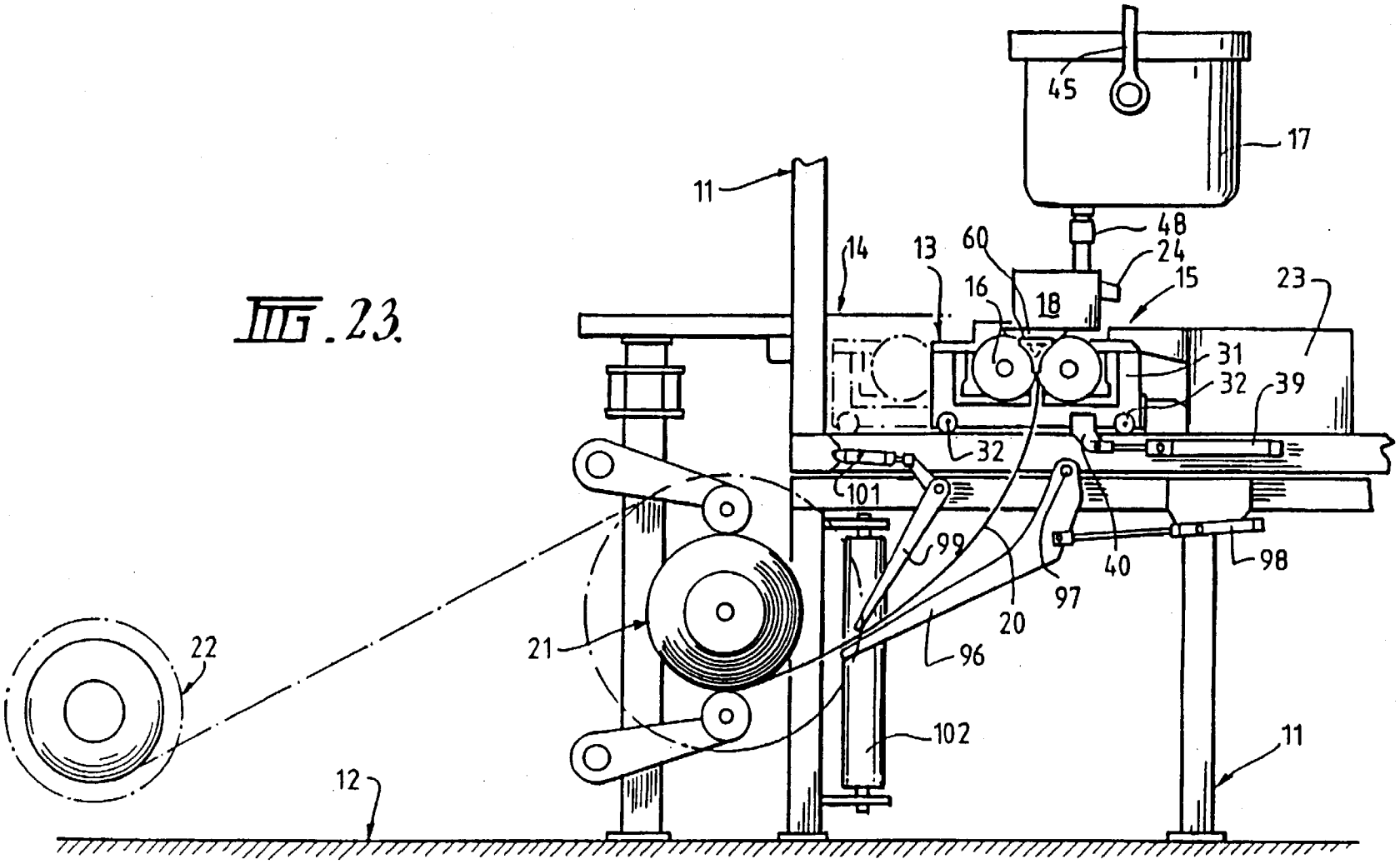
FIG. 23 is a side elevation of the strip caster shown in FIG. 22.
Figure 24:
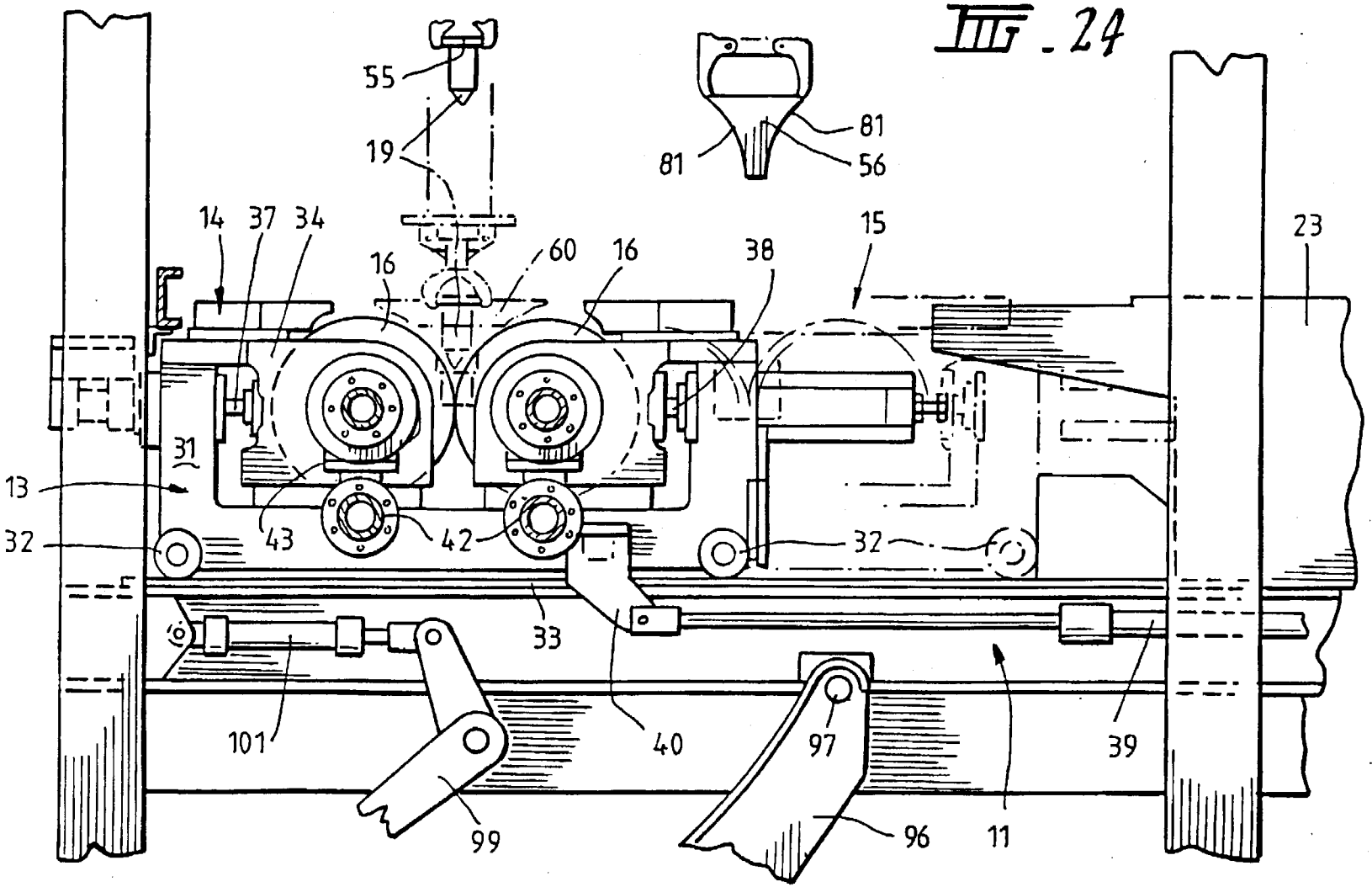
FIG. 24 is a vertical cross-section on the line 24—24 in FIG. 22.
Figure 25:
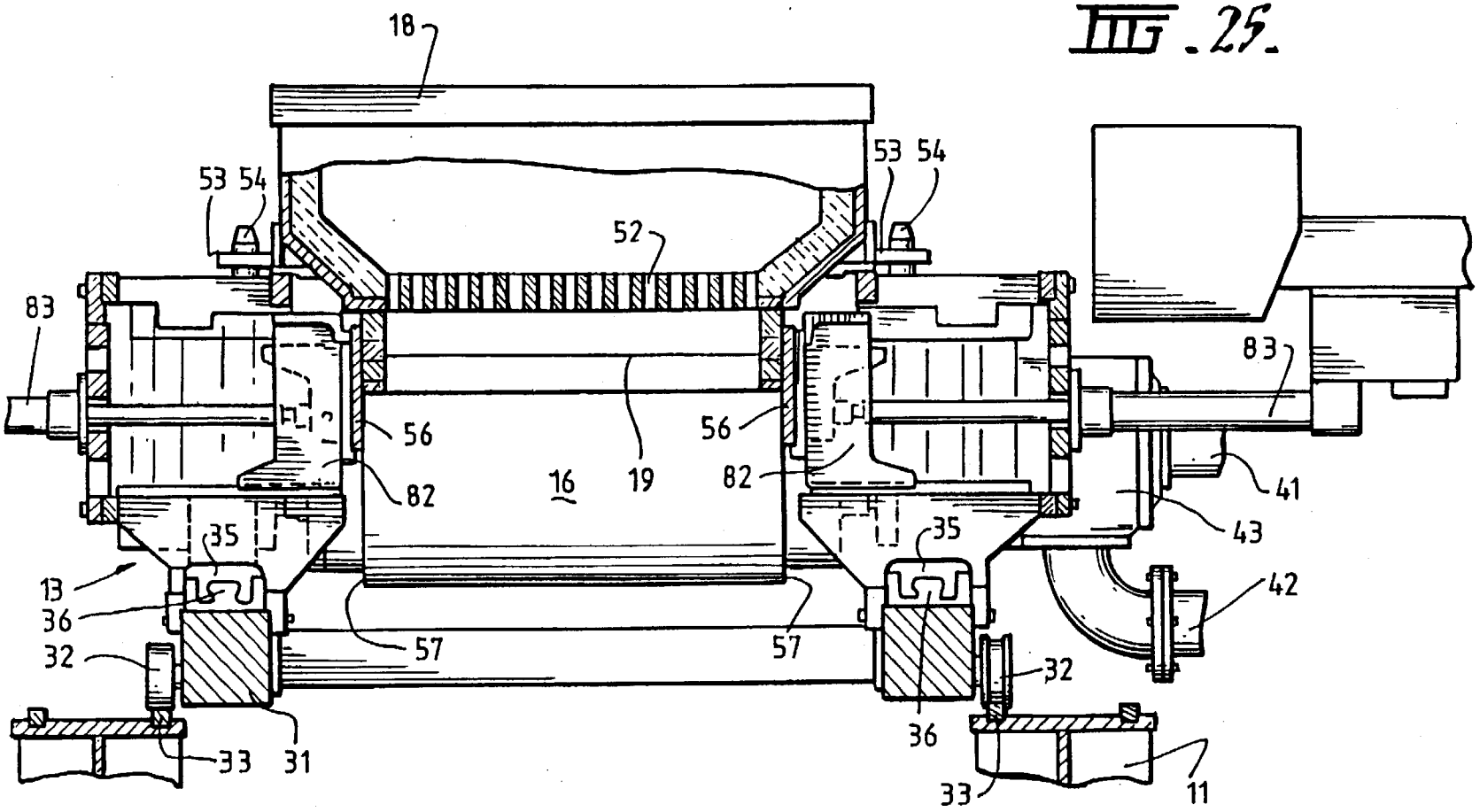
FIG. 25 is a vertical cross-section on the line 25—25 in FIG. 22.
Figure 26:
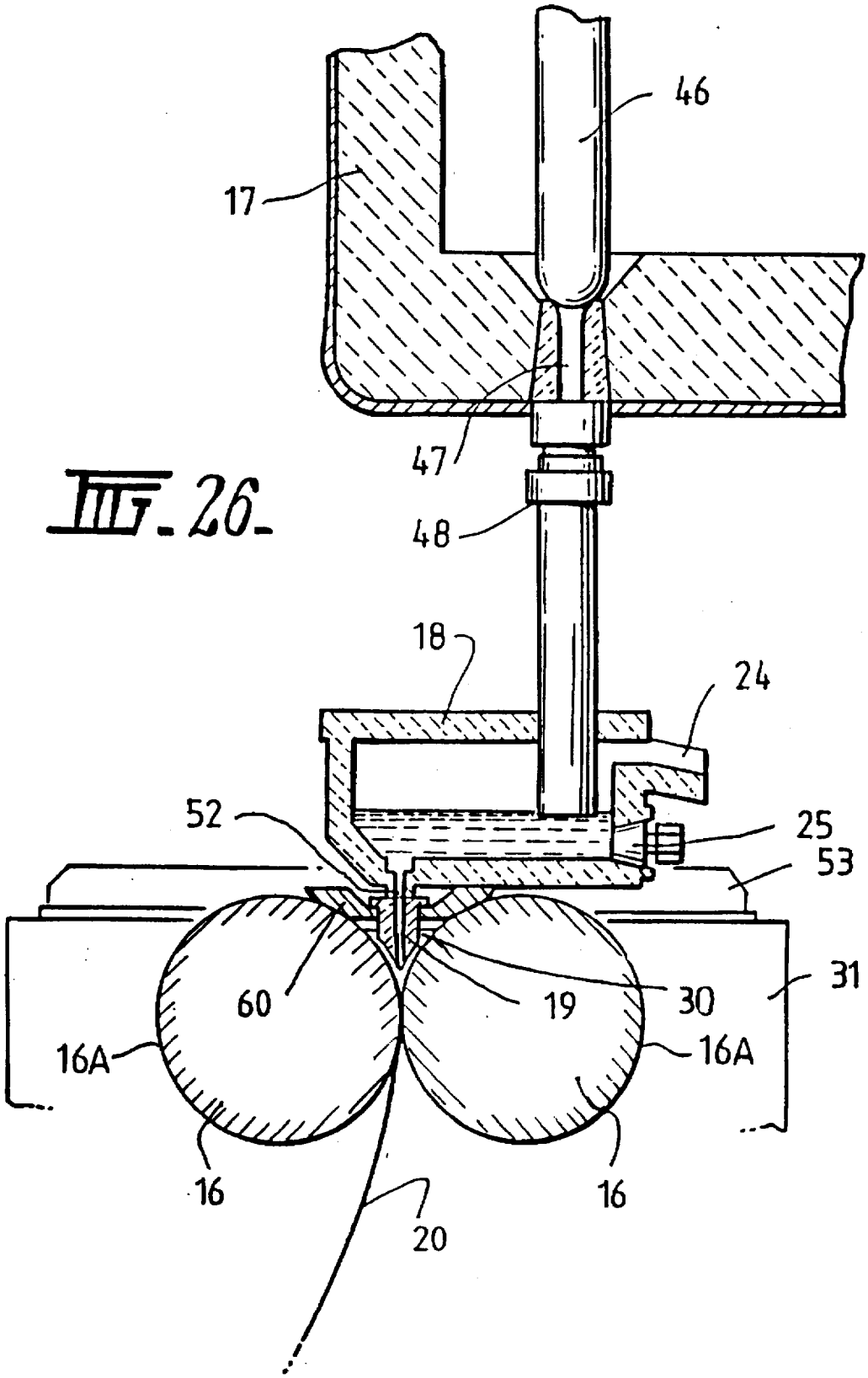
FIG. 26 is a vertical cross-section on the line 26—26 in FIG. 22.

Model calculations demonstrate that the thickness of the layer should not be more than about 5 microns, otherwise the potential improvement in heat flux due to the enhanced wettability of the layer is completely offset by the increased resistance to heat flux due to the thickness of the layer. FIG. 21 plots the results of model calculations assuming perfect wettability. This supports the experimental observations and further indicates that the oxide layer should be less than 5 microns thick and preferably of the order of 1 micron thick or less.

FIGS. 22 to 26 illustrate a twin roll continuous strip caster which has been operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a tundish 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16 and to enable the rolls to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the tundish through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Full particulars of a twin roll caster of the kind illustrated in FIGS. 22 to 26 are more fully described in our U.S. Pat. Nos. 5,184,668 and 5,277,243 and International Patent Application PCT/AU93/00593. In accordance with the present invention steel has been cast in such apparatus with steel melt compositions chosen such that the deoxidation products produce an oxide coating on the casting rolls which has a major liquid fraction at the casting temperature. As a result, it has been confirmed that a preferred MO6 steel composition to achieve optimum results is as follows:

| | |
|---|---|
| Carbon | 0.06% by weight |
| Manganese | 0.6% by weight |
| Silicon | 0.28% by weight |
| Aluminium | ≦0.002% by weight |
| Melt free oxygen | 60–100 parts per million. |

Figure 27:
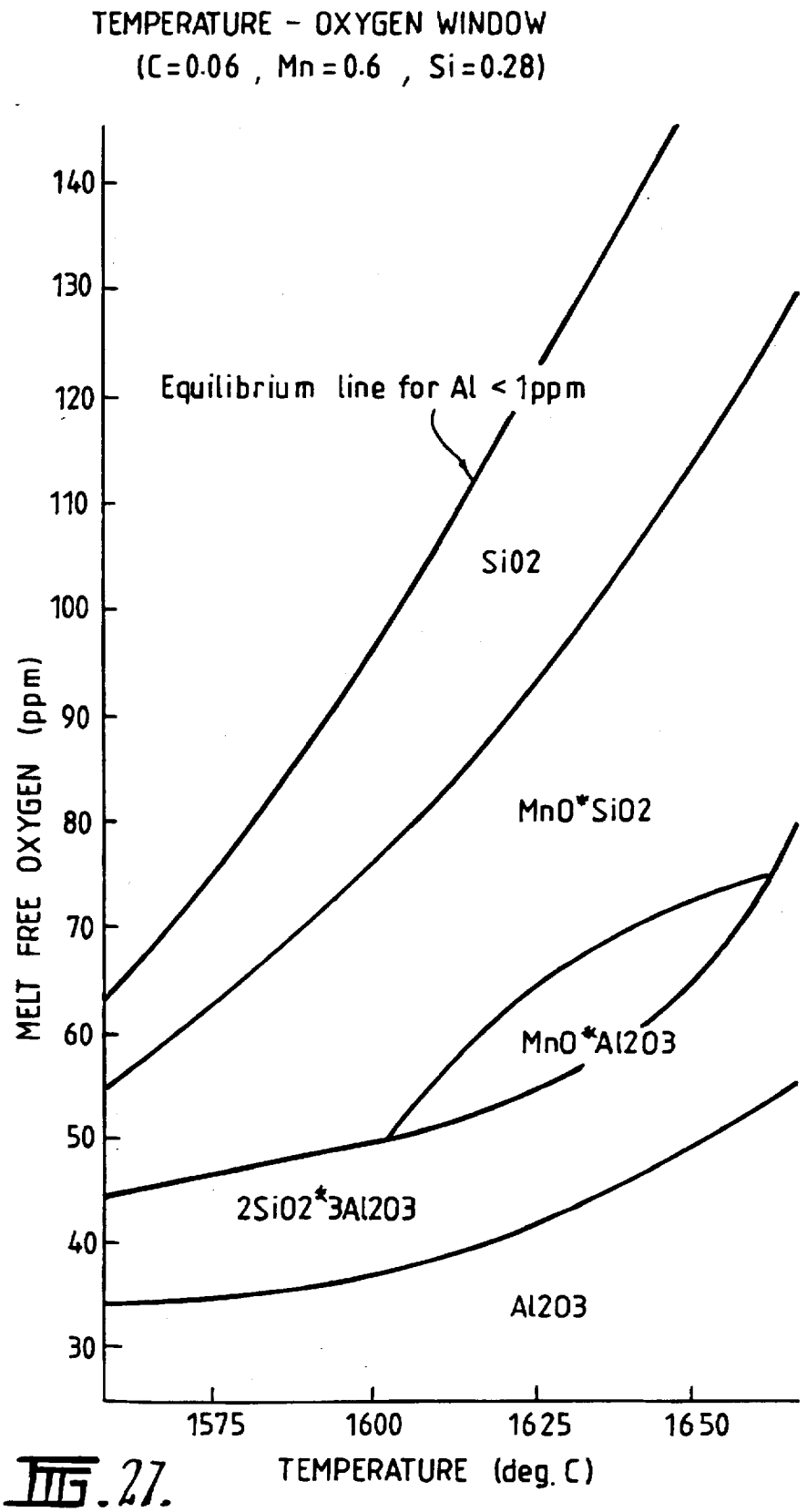
FIG. 27 illustrates the oxide phases present in a melt of manganese/silicon killed steel melt.

It has also been determined that with manganese/silicon killed steels the melt free oxygen level is important. FIG. 27 illustrates the oxide phases present in a MO6 steel of the preferred composition over a range of melt temperatures at differing free oxygen levels. It is preferred to maintain conditions which produce $MnO+SiO_2$ and to avoid the conditions which produce either $Al_2O_3$ or solid $SiO_2$ oxides. It is therefore preferred to have a melt free oxygen level in the range 60 to 100 parts per million from melt temperatures below 1675° C.

It has further been determined that a suitable AO6 composition to achieve optimum results with appropriate calcium addition is as follows:

| | |
|---|---|
| Carbon | 0.06% by weight |
| Manganese | 0.25% by weight |
| Silicon | 0.015% by weight |
| Aluminium | 0.05% by weight |

The coating on the roll may be produced entirely by build up of oxides from the casting pool. In this case it may be necessary for an initial quantity of strip to be produced before there is sufficient build up to produce a partially liquid layer to the extent to achieve the desired heat flux consistent with the speed of strip production. There may thus be an initial start up period which will produce scrap product before stable high heat flux conditions are achieved.

Rather than rely on the build up of oxides on the roll it is feasible within the scope of the present invention to apply an appropriate oxide composition to the roll surfaces immediately in advance of their entry into the pool or to provide the rolls with a permanent coating of oxides which partially melt on contact with the casting pool. Suitable low melting point coating material could be rhodium oxide, potassium oxide and bismuth oxide.

The invention is not limited in its application to twin roll casters and it may be applied in any continuous strip casting operation such as casting carried out on a single roll caster or a belt caster. It may also find application in other casting processes in which metal must be rapidly solidified by contact with a chilled casting surface.

I claim:

1. A method of casting steel strip comprising:

introducing molten steel into a nip between a pair of parallel chilled casting rolls to form a casting pool of the molten steel supported on casting surfaces of the rolls above the nip, said casting surfaces having an Arithmetic Mean Roughness Value ($R_a$) of less than 5 microns;

rotating the rolls to produce a solidified steel strip delivered downwardly from the nip;

forming on each of the casting surfaces of the rolls during metal solidification a layer of oxide material, a major proportion of which layer is liquid at the commencement of steel solidification on the casting surfaces, said molten steel having a composition selected so as to form said oxide material from the molten steel, said oxide material being deposited on the casting surfaces by the rotation of the rolls in contact with the molten steel to form said layer, said oxide material forming liquid oxide phases at the casting temperature to produce said major proportion of liquid in the layer.

2. A method as claimed in claim 1, wherein the liquid of said layer has a wetting angle of less than 40° on said casting surface.

3. A method as claimed in claim 1, wherein said layer is less than 5 microns thick.

4. A method as claimed in claim 3, wherein said layer is no more than 1 micron thick.

5. A method as claimed in claim 1, wherein the liquid fraction of said layer is at least 0.75.

6. A method as claimed in claim 1, wherein the molten steel is a manganese/silicon killed steel and said layer is a slag containing a mixture of iron, manganese and silicon oxides and wherein the proportions of manganese and silicon oxides in the slag is such that a major part of those oxides is in the form of liquid phases.

7. A method as claimed in claim 6, wherein the slag contains MnO and $SiO_2$ in proportions of about 75% MnO and 25% $SiO_2$.

8. A method as claimed in claim 6, further comprising controlling the free oxygen to the casting pool to enhance formation of iron oxide and of MnO and $SiO_2$ in the slag.

9. A method as claimed in claim 6, wherein the steel melt is generally of the following composition:

| | |
|---|---|
| Carbon | 0.06% by weight |
| Manganese | 0.6% by weight |
| Silicon | 0.28% by weight |
| Aluminum | ≦0.002% by weight. |

10. A method as claimed in claim 1, wherein the molten steel is an aluminum killed steel such that said layer is a slag containing a mixture of iron, silicon and aluminum oxides and comprising the step of adding calcium to the molten steel such that the proportion of calcium to aluminum in the melt is in the range of 0.2 to 0.3 by weight.

11. A method as claimed in claim 10, wherein the molten steel is an aluminum killed steel comprising about 0.06% by weight of carbon, about 0.25% by weight of manganese, about 0.15% by weight of silicon, about 0.05% by weight of aluminum and a purposeful addition of calcium such that the proportion of calcium to aluminum in the melt is in the range 0.2 to 0.3 by weight.

* * * * *